US010934148B2

(12) United States Patent
Costello

(10) Patent No.: US 10,934,148 B2
(45) Date of Patent: Mar. 2, 2021

(54) FILLER MACHINE

(71) Applicant: Patent Agencies Limited, Auckland (NZ)

(72) Inventor: Anthony William Costello, Kerikeri (NZ)

(73) Assignee: Patent Agencies Limited, Auckland (NZ)

( * ) Notice: Subject to any disclaimer, the term of this patent is extended or adjusted under 35 U.S.C. 154(b) by 0 days.

(21) Appl. No.: 16/690,453

(22) Filed: Nov. 21, 2019

(65) Prior Publication Data

US 2020/0156917 A1 May 21, 2020

Related U.S. Application Data

(63) Continuation of application No. 15/326,930, filed as application No. PCT/NZ2015/050095 on Jan. 17, 2017, now Pat. No. 10,519,017.

(30) Foreign Application Priority Data

Jul. 21, 2014 (NZ) ..... 627732

(51) Int. Cl.

| | |
|---|---|
| ***B67B 3/10*** | (2006.01) |
| ***B67C 3/06*** | (2006.01) |
| ***B67C 3/20*** | (2006.01) |
| ***B67B 3/02*** | (2006.01) |
| ***B65B 3/22*** | (2006.01) |

(Continued)

(52) U.S. Cl.

CPC ..... *B67C 3/206* (2013.01); *B65B 3/22* (2013.01); *B65B 31/042* (2013.01); *B65B 31/044* (2013.01); *B65B 39/12* (2013.01); *B67B 3/02* (2013.01); *B67B 3/10* (2013.01); *B67B 3/2066* (2013.01); *B67C 3/06* (2013.01); *B67C 3/204* (2013.01); *B67C 3/24* (2013.01);

(Continued)

(58) Field of Classification Search

CPC ..... B67C 3/206; B67C 3/204; B67C 3/24; B67C 3/26; B67C 3/28; B67C 3/06; B67C 2003/2654; B67B 3/2066; B67B 3/10; B67B 3/02; B65B 3/22; B65B 31/042; B65B 31/044; B65B 39/12

See application file for complete search history.

(56) References Cited

U.S. PATENT DOCUMENTS

| | | | |
|---|---|---|---|
| 1,825,751 | A | 10/1931 | Meyer |
| 1,953,644 | A | 4/1934 | Calleson |

(Continued)

FOREIGN PATENT DOCUMENTS

| | | |
|---|---|---|
| FR | 1570642 | 6/1969 |
| GB | 2134225 | 8/1984 |

OTHER PUBLICATIONS

Examination Report dated Apr. 2, 2019 in Australian Patent Application No. 2015-294772, all pages.

(Continued)

*Primary Examiner* — Nicolas A Arnett

(74) *Attorney, Agent, or Firm* — Kilpatrick Townsend & Stockton LLP

(57) ABSTRACT

The present invention relates to a filler machine and method. The filler machine and method allow efficient and/or accurate filling of containers such as bottles, and have particular application to filling bottles or similar containers with carbonated beverages.

17 Claims, 18 Drawing Sheets

(51) Int. Cl.

| | |
|---|---|
| ***B65B 31/04*** | (2006.01) |
| ***B65B 39/12*** | (2006.01) |
| ***B67B 3/20*** | (2006.01) |
| ***B67C 3/24*** | (2006.01) |
| ***B67C 3/26*** | (2006.01) |
| ***B67C 3/28*** | (2006.01) |
| ***B67C 7/00*** | (2006.01) |

(52) U.S. Cl.
CPC ..... *B67C 3/26* (2013.01); *B67C 3/28* (2013.01); *B67C 7/004* (2013.01); *B67C 2003/2654* (2013.01)

(56) References Cited

U.S. PATENT DOCUMENTS

| | | | | | |
|---|---|---|---|---|---|
| 2,142,302 | A * | 1/1939 | Miner | B67B 3/10 | 53/362 |
| 3,170,607 | A * | 2/1965 | Anthon | B65D 45/02 | 222/400.7 |
| 3,191,352 | A * | 6/1965 | Kelly | B67B 3/18 | 53/432 |
| 3,336,728 | A * | 8/1967 | Monaco | B67B 3/18 | 53/334 |
| 3,830,405 | A | 8/1974 | Jaeger | | |
| 3,946,540 | A * | 3/1976 | Solberg | B67B 3/10 | 53/341 |
| 3,946,770 | A | 3/1976 | Trinne | | |
| 4,055,202 | A | 10/1977 | Greene | | |
| 4,221,105 | A * | 9/1980 | Guest | B67B 3/18 | 53/488 |
| 4,356,680 | A * | 11/1982 | Guest | B67B 3/18 | 53/412 |
| 4,729,204 | A * | 3/1988 | Weiss | B65B 31/00 | 53/88 |
| 5,564,481 | A | 10/1996 | Clusserath | | |
| 7,051,491 | B2 * | 5/2006 | Wohlgemuth | B65B 7/2821 | 53/281 |
| 7,159,374 | B2 * | 1/2007 | Abercrombie, III | B65B 31/006 | 206/219 |
| 7,347,032 | B2 * | 3/2008 | Cirio | B67B 3/18 | 53/331.5 |
| 1,188,044 | A1 | 6/2016 | Clay | | |
| 10,519,017 | B2 * | 12/2019 | Costello | B67C 3/204 | |
| 2008/0271713 | A1 | 11/2008 | Morris | | |
| 2012/0017874 | A1 | 1/2012 | Yildirim | | |

OTHER PUBLICATIONS

Search Report and Written Opinion corresponding to PCT/NZ2015/050095, dated Mar. 16, 2016, twelve pages.

* cited by examiner

FILLER MACHINE

CROSS-REFERENCE TO RELATED APPLICATIONS

This application is a continuation of U.S. patent application Ser. No. 15/326,930, filed Jan. 17, 2017, which is a U.S. National Stage Application of PCT International Application No. PCT/NZ2015/050095, filed Jul. 20, 2015, which claims priority to New Zealand Patent Application No. 627732, filed Jul. 21, 2014, the disclosures of which are incorporated by reference herein in their entireties.

FIELD OF THE INVENTION

The present invention relates to a filler machine and in particular to a filler machine useful for filling bottles or similar containers with liquid such as beverages. In particular, this invention relates to a filler machine that may be used to fill bottles or similar containers with carbonated beverages.

BACKGROUND

There are many different machines currently available that may be used to fill a container such as a bottle containing a beverage. Such machines operate using a variety of different principles. These principles depend on a number of factors such as the nature of the liquid and the scale of the filling operation.

Filling containers such as bottles with carbonated beverages such as beer or carbonated soft drinks can present some particular challenges. During the filling process, the carbonated beverage can foam and can lose some of its carbonation. Loss of carbonation can leave the beverage "flat" and excess foaming can also cause wastage and spillage that needs to be cleaned up.

One aim of most currently available machines is to minimise agitation of the carbonated liquid during the filling process, to reduce foaming and decarbonation of the liquid. This is usually achieved by having a relatively slow fill speed (although chilling the carbonated liquid may also help minimise excess foaming).

Currently used filling techniques generally involve the use of a filler machine that has a header tank of the liquid above the bottle. This header tank is pressurised with carbon dioxide. A bottle to be filled is sealed onto a filler head of the filler machine and the bottle is normally then evacuated and/or gas purged to remove oxygen. Next the bottle is filled with carbon dioxide to the same pressure as the header tank above. The bottle is filled using gravity. To avoid excessive foaming and therefore decarbonation of the beverage, this process is carried out relatively slowly. For example, a fill time of at least 15 to 20 seconds would be within normal bounds.

Alternatively, some hand operated machines bleed the gas out of the bottle so the liquid can flow into the bottle. The bottle is then vented and sent to a capper. These hand operated machines also provide only relatively slow filling speeds.

Counter-pressure bottle fillers are well known in the art and can help to reduce foaming and decarbonation. In use, a counter-pressure bottle filler is connected to a container of carbonated beverage and to a carbon dioxide tank. The counter-pressure bottle filler is inserted into a bottle to be filled. The opening of the bottle is then secured with a stopper and a valve to the carbon dioxide tank is opened to allow carbon dioxide to fill the bottle. A bleed valve is opened to allow air to escape. The bleed valve is then closed, allowing the bottle to be pressurised to the same pressure as the container of carbonated beverage. The valve to the carbon dioxide tank is closed and a valve to the container of carbonated beverage is opened. As the pressure in the bottle is the same as the pressure in the container of carbonated beverage, the beverage will not flow into the bottle. Flow is achieved by opening the bleed valve slightly. This gradually reduces the pressure in the bottle and the beverage will slowly fill the bottle.

This arrangement has several drawbacks. The procedure involves a number of steps that must be carried out in the correct order to avoid excessive foaming and/or oxidation of the beverage, or excessive spraying of the beverage from the bottle. This arrangement also provides for only relatively slow filling of the bottle.

U.S. Pat. No. 7,730,912 describes a bottle filler that provides an alternative to counter-pressure bottle fillers. The bottle filler of U.S. Pat. No. 7,730,912 is designed to reduce oxidation of a carbonated beverage as it is bottled. A long hose is provided, which gradually reduces the pressure of the beverage on the way to the filler. A valve seat is located at the bottom of a filling tube to allow the carbonated beverage to flow into the bottle from the bottom of the bottle. Two filling tubes are placed one inside the other to form an annulus that allows carbon dioxide to be forced into the bottom of the bottle to purge the bottle of air prior to filling. A disadvantage of the bottle filler of U.S. Pat. No. 7,730,912 however is that it provides a relatively slow fill rate and does not allow for accurate measurement of volume.

Another aim when filling bottles is to accurately fill each bottle with a predetermined volume of beverage. This is to reduce or minimise wastage, and to ensure consumers receive the stated volume of beverage purchased. Currently used filling techniques do not always provide accurate fill levels.

There is an ongoing need for filler machines and methods that allow more efficient and/or accurate filling of containers such as bottles. There is a further ongoing need to provide a filler machine and method that at least provides a useful alternative to known filler machines and methods.

References to any external documents in this specification are for the purpose of providing a context for discussing the present invention. Such references are not, and should not be taken as, an acknowledgement or any form of suggestion that the documents are prior art or form part of the common general knowledge.

SUMMARY OF THE INVENTION

In one aspect, the present invention provides a filler machine comprising a charging means and a filler means, wherein:

- the charging means including at least one inlet means provided with at least one valve means, at least one filler cylinder adapted to contain a liquid, at least one filler piston and at least one pressure regulating means, and
- the arrangement is such that the at least one pressure regulating means allows a liquid to be pushed into the at least one filler cylinder under pressure, while maintaining a first controlled pressure on the other side of the filler piston from the side containing the liquid to ensure the liquid in the at least one filler cylinder is maintained under pressure.

Preferably, the arrangement is such that the at least one pressure regulating means allows the liquid in the filler cylinder to be moved from the filler cylinder to the filler means at a second controlled pressure. Preferably, the filler means comprises at least one valve means, at least one transfer means and at least one filler tube, the filler tube a seal at an outer end thereof.

Preferably, the at least one transfer means comprises hosing or piping.

Preferably, the filler means further comprises at least one filler tube lifting means.

Preferably, the arrangement is such that the at least one filler tube lifting means is activated by movement of the at least one filler piston.

Preferably, the filler machine includes an adjustable stop linked to the filler tube lifting means, the arrangement is such that the outer end of the at least one filler tube is adapted to remain within liquid flowing into the container, during filling of a container.

Preferably, the filler machine further comprises at least one adjustable filler piston stop means.

In another aspect, the present invention provides a method of filling a container, the method comprising the steps of charging a filler machine and filling a container from the charged filler machine, the charging step comprising pushing a liquid into a filler cylinder of the filler machine under pressure, while maintaining a first controlled pressure on the other side of the filler piston from the side containing the liquid to ensure the liquid in the cylinder is maintained under pressure, the filling step comprising moving the liquid from the filler cylinder to filler means of the filler machine under a second controlled pressure, opening a valve means to allow the liquid to exit a filler tube of the filler machine into the container, and maintaining an outer end of a filler tube within liquid flowing into the container, during filling of a container.

Preferably, once the filler cylinder has been filled, an inlet means of the filler machine is closed and the liquid is isolated.

Preferably, the cylinder charging step and control of the lift of the filler tube result in the container being filled with a predetermined volume of liquid.

In a further aspect, the present invention provides a filler machine comprising a charging means and a filler means, wherein:

the charging means includes at least one inlet means provided with at least one valve means, at least one filler cylinder adapted to contain a liquid, at least one filler piston and at least one pressure regulating means, and the filler means comprises a container locating and holding means, at least one vent valve and at least one first sealing means, the arrangement is such that the at least one pressure regulating means allows a liquid to be pushed into the at least one filler cylinder under pressure, while maintaining a first controlled pressure on the other side of the filler piston from the side containing the liquid to ensure the liquid in the at least one filler cylinder is maintained under a controlled pressure, the at least one vent valve provides for variable release of pressure from a container being filled to control the speed at which the container is filled, and the at least one first sealing means and the inlet means assist in maintaining the pressure to at least the controlled pressure until capping of the container being filled.

Preferably, the means for locating and holding the container is a rotary star wheel assembly.

Preferably, the means for locating and holding the container to be filled includes the first sealing means, a second sealing means, a seal holder and a sealing plate.

Preferably, the at least one first sealing means is adapted to create and maintain a seal between the seal holder and the sealing plate when holes or openings provided therein partially or fully align.

Preferably, the vent valve comprises a spool, a cylinder and at least one exhaust hole or opening. More preferably, the arrangement of the vent valve is such that, in use, retraction of the cylinder moves the spool to expose one or more of the exhaust hole or openings.

Preferably, the inlet means is a three-way inlet valve.

Preferably, the three-way inlet valve comprises a valve spool, liquid inlet, liquid outlet and an outlet to a filler means. More preferably, the arrangement of the three-way valve is such that, in use, the valve is open and is activated to close once the filler means is charged with liquid.

In a still further aspect, the present invention provides a method of filling a container, the method comprising the steps of charging a filler machine and filling a container from the charged filler machine, the charging step comprising pushing a liquid into a filler cylinder of the filler machine under pressure, while maintaining a controlled pressure on the other side of the filler piston from the side containing the liquid to ensure the liquid in the cylinder is maintained under pressure, and the filling step comprising moving the liquid from the filler cylinder to the container via filler means of the filler machine, under the controlled pressure, wherein variable release of pressure from the container as it is being filled is controlled by at least one vent valve, thereby controlling the speed at which the container is filled, the controlled pressure is maintained until capping of the container being filled by at least one first sealing means and the inlet means, and an outer end of a filler tube within liquid flowing into the container, during filling of a container.

This brief summary of the invention broadly describes the features and advantages of certain embodiments of the invention. Further features and advantages will be described in the detailed description of the invention that follows.

Novel features that are believed to be characteristic of the invention will be better understood from this detailed description when considered in connection with the accompanying drawings. However, the accompanying drawings are intended to help illustrate the invention or assist with understanding the invention, and are not intended to define the scope of the invention.

BRIEF DESCRIPTION OF THE DRAWINGS

The invention will now be described by way of example only and with reference to the following drawings.

DETAILED DESCRIPTION OF THE INVENTION

Figures 1A, 1B, 1C, 1D:
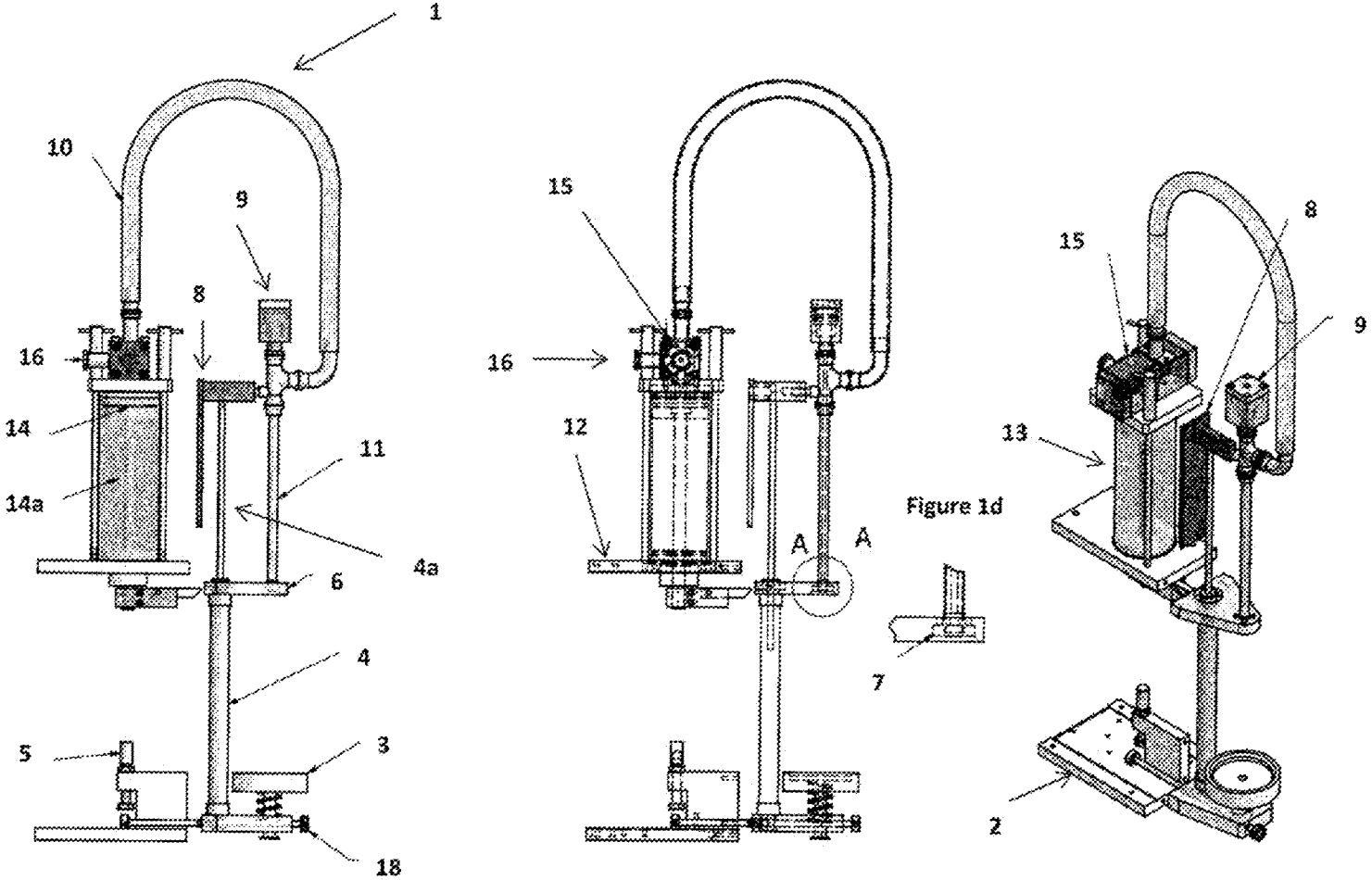
FIG. 1*a*: shows a side view of a filler machine according to a first aspect of the present invention, in a first starting position.
FIG. 1*b*: shows a cross-sectional view of the filler machine shown in FIG. 1*a*.
FIG. 1*c*: shows a second perspective view of the filler machine shown in FIG. 1*a*.
FIG. 1*d*: shows the detail of A-A of FIG. 1*b*.

The following description is given with reference to filling bottles with carbonated beverages. It should be appreciated, however, that the filler machine and method of the present invention may be used to fill other types or containers, and to fill containers with other types of liquids.

The amount of carbon dioxide dissolved in a carbonated beverage (the amount of carbonation) is governed by the temperature and pressure of the beverage. During operation of traditional filler machines a pressure drop occurs once the beverage exits the supply tank. The pressure drop causes carbon dioxide to be released from the beverage, which causes agitation and therefore foaming of the beverage to occur as the carbon dioxide escapes the beverage.

The tendency of carbonated beverages to foam has led to the generally held view that it is not possible to move carbonated beverages quickly into bottles or cans during the filling process without causing excess foaming.

Most currently available filler machines are therefore designed to minimise agitation of the beverage during the filling process. This reduces foaming and oxidation of the beverage but means that filling will usually be a relatively slow process.

The present invention provides a filler machine that allows a bottle to be filled with a carbonated beverage relatively quickly, without excess foaming occurring.

The filler machine of the present invention also allows accurate filling of a bottle with a predetermined volume of beverage.

In broad terms, the present invention provides a filler machine comprises a charging means and filler means, which together include the filler tube, a filler cylinder, a filler piston, a plurality of valves, pressure regulators and a pipe or hose for connecting the filler cylinder to the filler tube. Further details of specific embodiments of the present invention are described in more detail below.

During operation, a method of using the filler machine of the present invention involves two main phases, the charging phase and the filling phase. In the charging phase, the filler cylinder is charged with beverage from a beverage supply tank. In the filling phase, the beverage is moved from the charged filler cylinder into a bottle.

During these two phases, the pressure of the beverage is controlled. In the charging phase, the pressure is controlled to a first controlled pressure, and in the filling phase, the pressure is controlled to a second controlled pressure. The pressure is always higher than the carbonation pressure (noting that this pressure changes with temperature).

The filler machine of the present invention makes use of a pneumatic pressure over hydraulic pressure action to maintain the pressure of the carbonated beverage from the tank or keg storing the beverage to the exit point from the filler machine.

Because the carbonated beverage is transported right through the machine under pressure, no vapour cavities are created. This means the beverage cannot foam until it exits the filler machine into the bottle (where a pressure drop occurs). However, at the exit point, the filler machine of the present invention makes use of a mechanical linkage system attached to a shaft of the filler piston to ensure the filler tube is always located within the beverage as it is filling the bottle. This means foaming can be controlled as the beverage exits the machine.

The pneumatic aspect of filler machine operates as a modified positive displacement pump, where the pressure on both sides of the filler piston is controlled. In one embodiment, compressed gas is used to control the pressure of the beverage, using pressure regulators.

In general terms, the filler machine operates by opening an inlet valve allowing the pressurised beverage to be pushed from a supply tank into the filler cylinder, then closing the inlet valve and opening an outlet valve and pumping the beverage into the bottle under controlled pressure (for example using regulated compressed air on the back of the filler piston).

If a standard piston filler is used for carbonated beverages, the cavitation (formation of vapour cavities in the beverage) caused by the induction of the beverage would create foaming. To avoid this problem, the filler machine of the present invention controls the pressure of the beverage by using the pressurised carbonated beverage itself to drive the filler piston back during the charging phase, as is described in more detail below.

To ensure little or no cavitation or foaming occurs during the charging phase, the pressure on the other side of the filler piston from the side containing the beverage is controlled (this side of the filler piston is referred to as the "air pressure side"), generally by way of an adjustable pressure regulator. As the beverage is being forced into the filler cylinder, a pneumatic pressure is controlled on the air pressure side of the filler piston. For example, prior to charging the cylinder with the carbonated beverage, there is gas pressure on the air pressure side of the filler piston. During charging, the pressure of this gas is controlled by bleeding off or exhausting the gas in a controlled manner so that the pressure is always higher than the carbonation pressure but low enough to allow the pressurised beverage to push the piston so it charges the filler cylinder.

This controlling of the pressure on the air pressure side of the filler piston ensures the beverage is always under pressure, with the pressure of the beverage being higher than the pressure of the air on the air pressure side of the filler piston.

Once the beverage has been forced into the filler cylinder and the inlet valve is closed then the beverage is isolated.

During the filling phase, the second controlled (air) pressure is used to push the carbonated beverage along the pipe or hose and through the filler tube. A filler valve is located at the end of the filler tube so low pressure does not develop in the filler tube.

To fill a bottle, the filler tube of the filler machine is lowered into the bottle and then the filler valve located at the end of the filler tube opens just as the filler piston starts to pump the beverage. The filler valve may be designed to open at a controlled speed to slow the initial filling speed, for example by controlling the (exhaust) pressure on the pneumatically operated filler valve.

The filler machine is adapted to ensure that the filler tube stays under the level of the beverage the entire time the bottle is filling, no matter what the filling speed is. This allows foaming to be controlled (reducing or eliminating foaming).

In one embodiment of the invention, this is achieved by using the filler piston to control the travel of the filler tube upwardly within the bottle as the bottle is filled. This system ensures the end of the filler tube is always under the beverage once the filling has started, even if the filling speeds are changed, as the filler tube does not start to lift until well after the filling has started. The amount the bottle is filled before lifting begins can be changed by changing the gap between the lifter and the lifting plate.

A small amount of foam may deliberately be created at the start of the filling phase. This foam blanket drives out the air and inhibits oxygen ingression into the beverage.

Foaming during the filling phase may be controlled by the filler piston speed, which is influenced by the controlled pressure on the air pressure side of the filler piston, the size of the filler tube and by the size of the opening on the filler tube.

The pressure of the carbonated beverage, the size of the pipes (and valves) to the filler piston and the pressure on the air pressure side of the filler piston control the speed of filler piston induction. As already mentioned, in a preferred embodiment, the backpressure on the air pressure side of the filler piston is controlled by controlling the pressure and speed of the exhaust.

In addition to the ability to control foaming of the beverage, an adjustable stop provided by the filler machine of the present invention allows accurate delivery of a predetermined volume of beverage delivered to the bottle.

Aspects of the filler machine and method of the present invention will now be described with reference to the accompanying drawings.

A first aspect of the present invention is shown in FIGS. 1 to 7. This aspect of the invention is suitable for moderately carbonated beverages.

Referring firstly to FIG. 1, the present invention provides a filler machine 1. The filler machine 1 comprises a base 2, with an adjacent spring-loaded bottle support 3 and filler tube lift cylinder 4. The base 2 is provided with an adjustable filler stop 5.

At the top of the filler tube lift cylinder 4 is a first support 6, which includes bottle locator 7. Extending upwardly from the filler tube lift cylinder 4 is a portion 4*a*, which houses a filler tube guide 8. Attached to an upper end of the filler tube guide 8 is filler tube valve 9 and flexible hose 10. Also extending from the filler tube valve 9 is a filler tube 11.

Adjacent the first support 6 is a second support 12, housing a filler cylinder 13, which includes a filler piston 14 (with filler piston shaft 14*a*) and inlet valve 15. The inlet valve 15 is adapted to receive a beverage inlet means 16.

The start of a filling cycle is shown in FIG. 1. In this first starting position, the filler piston 14 is located in an "up" position, adjacent the inlet valve 15.

Figure 2C:
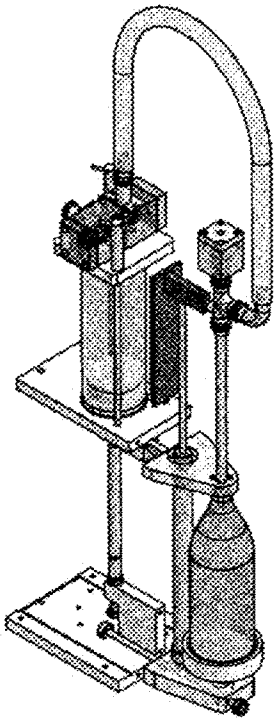
FIG. 2*c*: shows a perspective view of the filler machine shown in FIG. 2*a*.
Figure 2B:
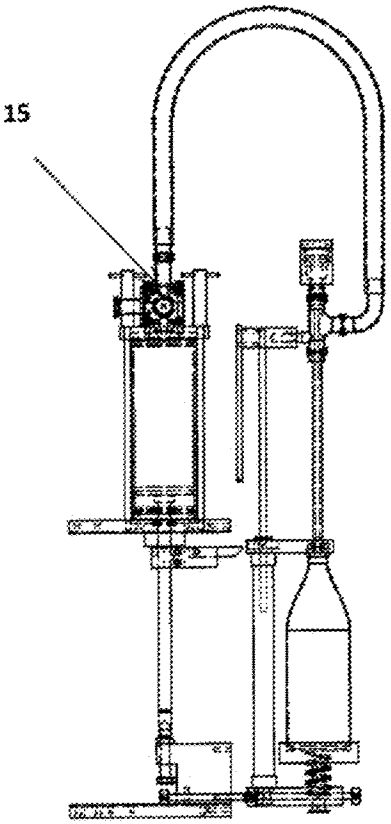
FIG. 2*b*: shows a cross-sectional view of the filler machine shown in FIG. 2*a*.
Figure 2A:
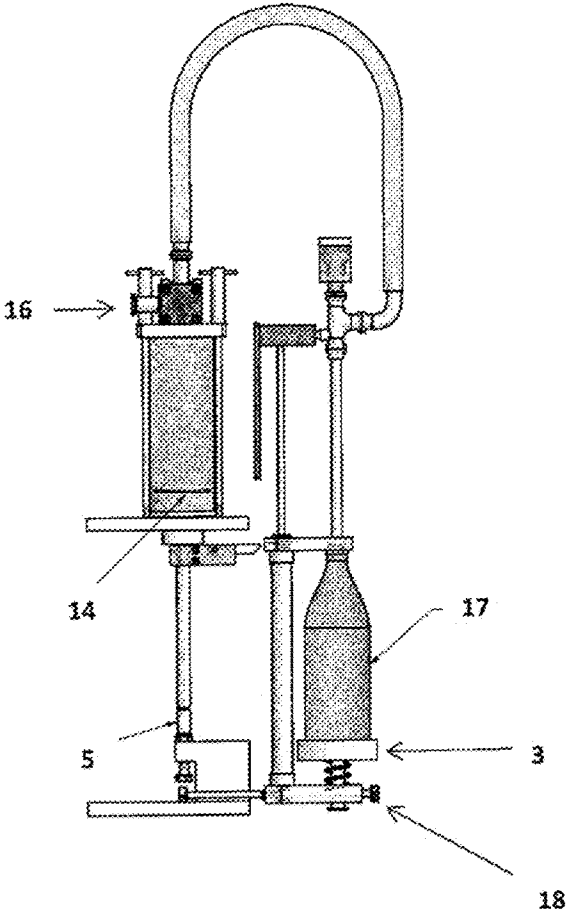
FIG. 2*a*: shows a side view of the filler machine shown in FIG. 1, in a second ready to activate position.

To fill a bottle with a carbonated beverage, a bottle 17 is located on the bottle support 3 as shown in FIG. 2. This is achieved by pushing down on the spring-loaded bottle support 3, placing the bottle 17 on the support and then releasing the bottle 17 so that the opening at the top of the bottle 17 is located and secured by the bottle locater 7. The bottle locator 7 is adapted to ensure a close fit between it and the opening of the bottle 17.

The beverage inlet means 16 is secured to a beverage source, such as a tank or keg (not shown). Once the bottle 17 is in place, the inlet valve 15, which for example may be a three-way valve, is opened. This results in carbonated beverage from the tank or keg being pushed under a first controlled pressure into the filler cylinder 13. This pushes the filler piston 14 down until it engages with the adjustable filler stop 5, as shown in FIG. 2. Air in the filler cylinder is bled out or exhausted using a pressure regulator (not shown). The three-way inlet valve 15 is then closed, keeping the contents of the tank or keg under pressure and at the same time the beverage in the filler piston 14 is isolated and so is no longer under pressure.

The volume of beverage entering the filler cylinder 13 may be adjusted by adjusting the position of the adjustable filler stop 5.

At the point in the cycle shown in FIG. 2, the charging phase is complete and the bottle 17 is ready to be filled. The filling phase may be commenced by activating a start button 18 or by other suitable automatic activating means.

Figure 3C:
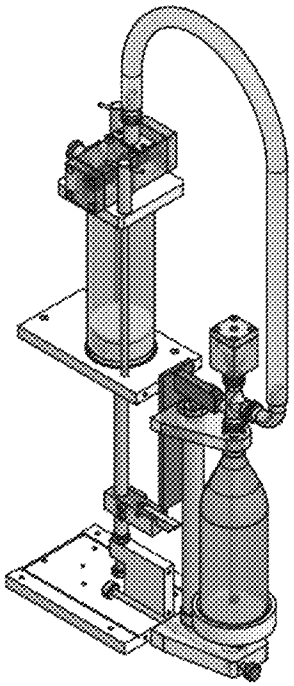
FIG. 3*c*: shows a perspective view of the filler machine shown in FIG. 3*a*.
Figure 3B:
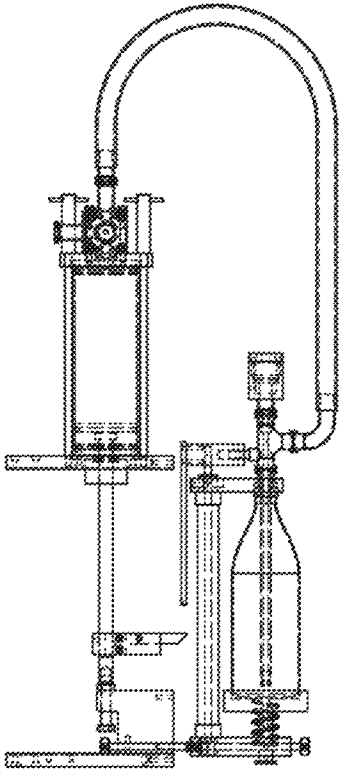
FIG. 3*b*: shows a cross-sectional view of the filler machine shown in FIG. 3*a*.
Figure 3A:
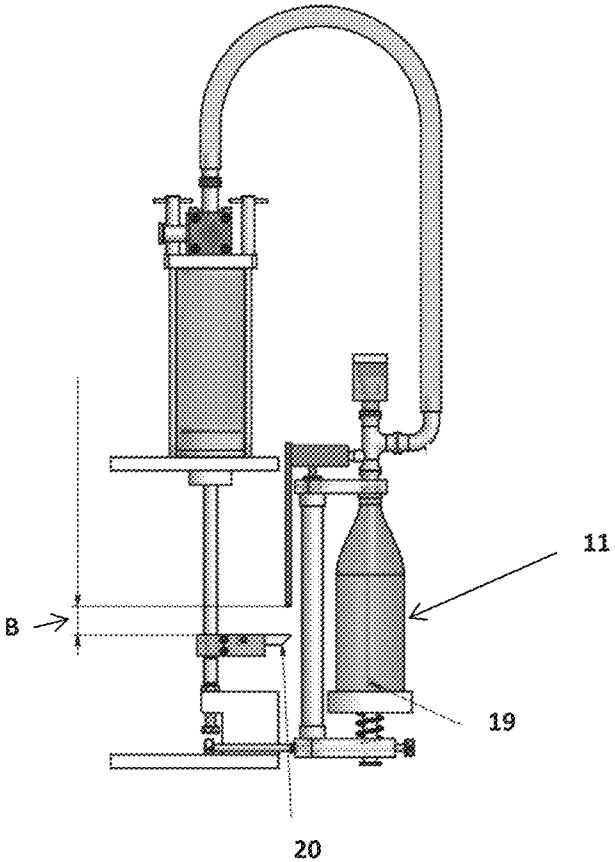
FIG. 3*a*: shows a side view of the filler machine shown in FIG. 1, in a third activated position.
Figure 4B:
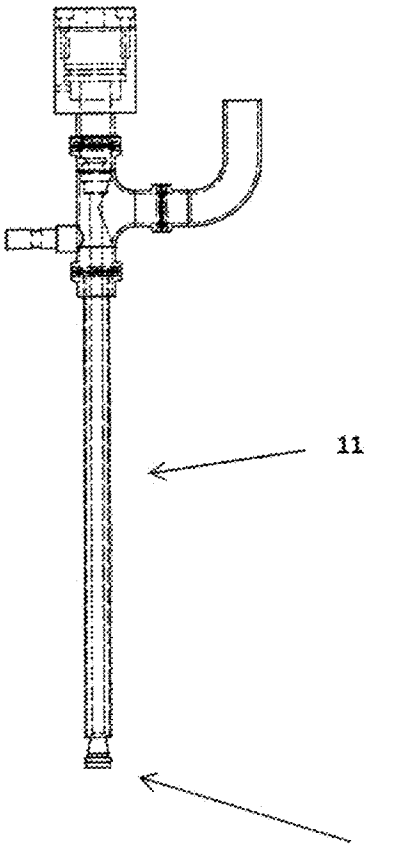
FIG. 4*b*: shows a cross-sectional view of a filler tube shown in FIG. 4*a*, in an open position.
Figure 4A:
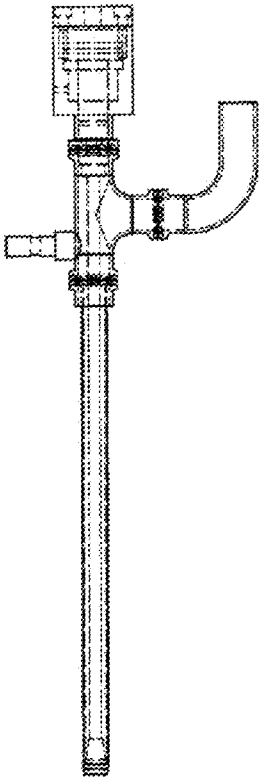
FIG. 4*a*: shows a cross-sectional view of a filler tube of the filler machine shown in FIG. 1, in a closed position.

Upon activation, the filler tube 11 moves down into the bottle 17 as shown in FIG. 3. The filler tube 11 comes to rest just above the bottom of the bottle 17, leaving enough space for a filler tube valve 19 located at the bottom of a filler tube 11 to open. The open and closed positions of the filler tube valve 19 are shown in FIG. 4.

A second controlled air pressure applied on the air pressure side of the filler piston 14 (via the pressure regulator, not shown) and the opening of the filler tube valve 19 causes the filler piston 14 to be pushed up, resulting in beverage located in the filler cylinder 13 moving through the inlet valve 15 into the flexible hose 10 and down into the bottle 17 via the filling valve 9 and filler tube 11.

As shown in FIG. 3, the filler machine 1 is also provided with a filler tube lifter 20, linked to the filler piston 14. In the embodiment shown, the filler tube lifter 20 is a pneumatic cylinder. When the start button 18 is pushed, this cylinder is retracted, under pressure, to move the filler tube 11 down. Once down, however, the air pressure is removed from the pneumatic cylinder. The pneumatic cylinder is then free to move independently, so the filler tube lifter 20 can lift the filler tube 11. Once filling is complete, air pressure may be reintroduced so the pneumatic cylinder may extend to remove the filler tube 11 from the bottle 17.

Figure 5C:
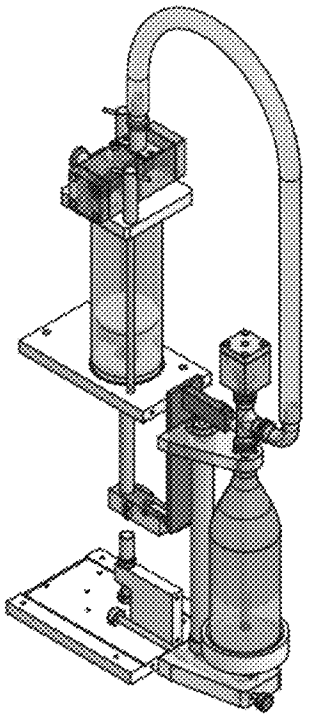
FIG. 5*c*: shows a perspective view of the filler machine shown in FIG. 5*a*.
Figure 5B:
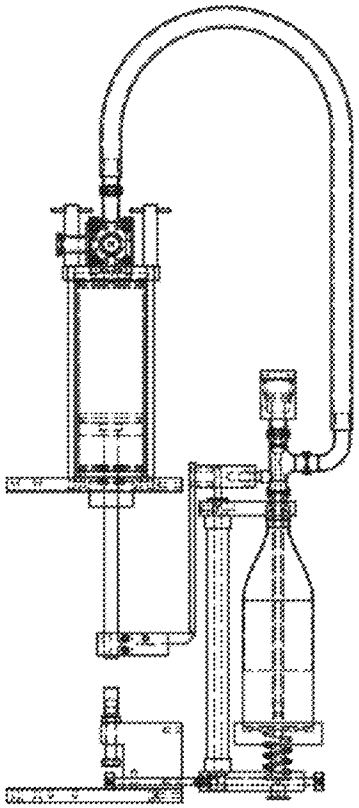
FIG. 5*b*: shows a cross-sectional view of the filler machine shown in FIG. 5*a*.
Figure 5A:
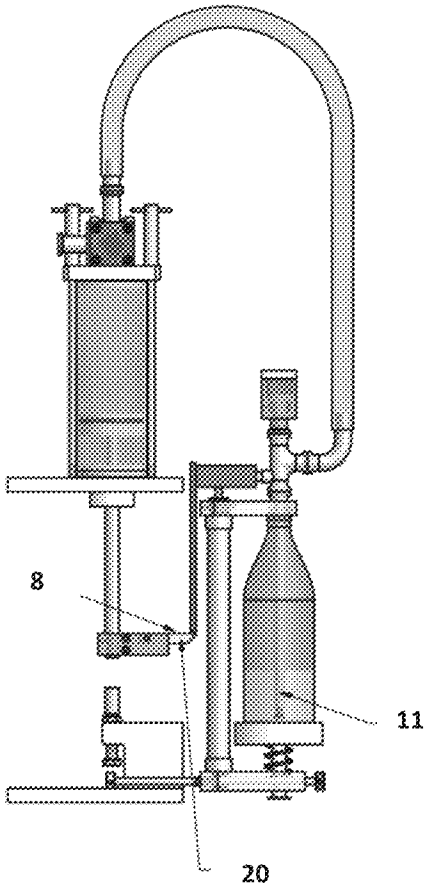
FIG. 5*a*: shows a side view of the filler machine shown in FIG. 1, in a fourth further activated position.

As the filler piston 14 moves up, pushing the beverage into the bottle 17 via the flexible hose 10, the filler tube lifter 20 moves up a predetermined distance B (see FIG. 3) until it touches the bottom of the filler tube guide 8. This position is shown in FIG. 5.

At this point, the bottle 17 is partially filled with beverage and the lower end of the filler tube 11 and the filler tube seal 19 are located within the beverage.

Figure 6C:
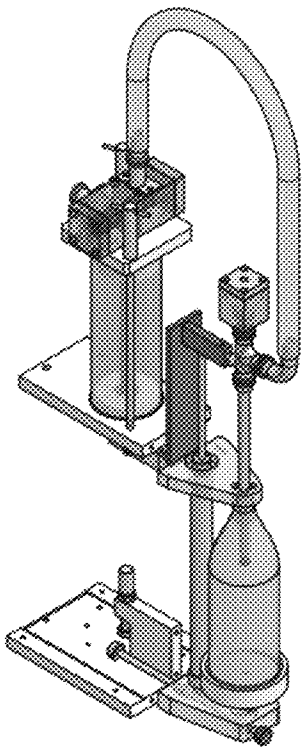
FIG. 6*c*: shows a perspective view of the filler machine shown in FIG. 6*a*.
Figure 6B:
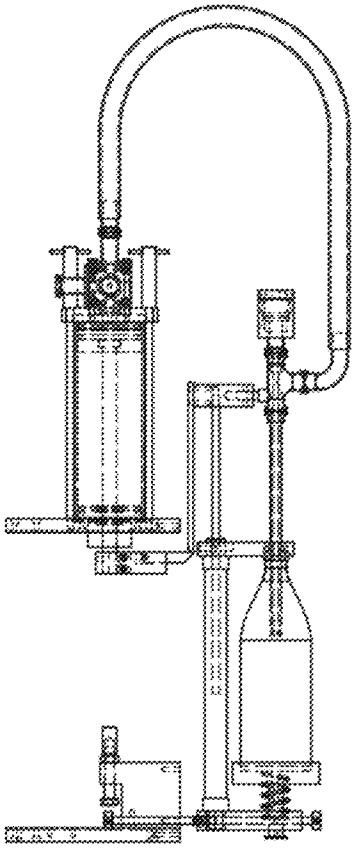
FIG. 6*b*: shows a cross-sectional view of the filler machine shown in FIG. 6*a*.
Figure 6A:
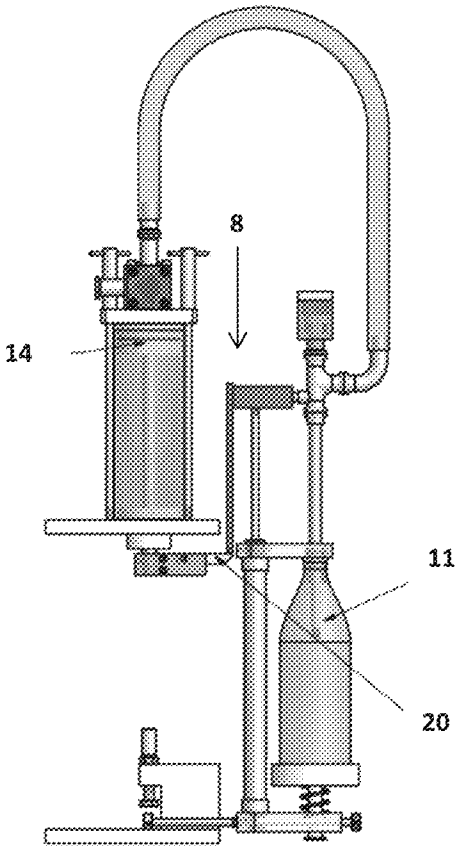
FIG. 6*a*: shows a side view of the filler machine shown in FIG. 1, in a fifth position, with a bottle filled with beverage.
Figure 7C:
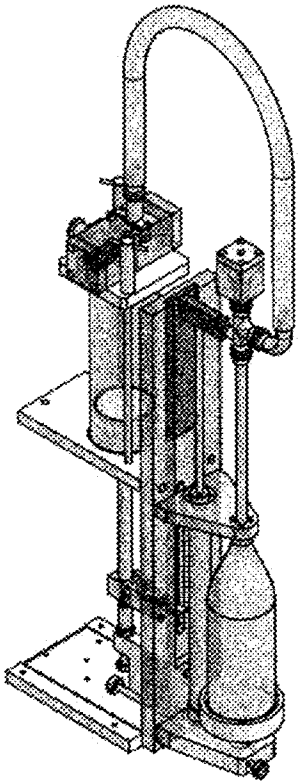
FIG. 7*c*: shows a perspective view of the filler machine shown in FIG. 7*a*.
Figure 7D:
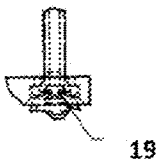
FIG. 7*d*: shows the detail of A of FIG. 7*b*, with the filler tube valve in a closed position.
Figure 7B:
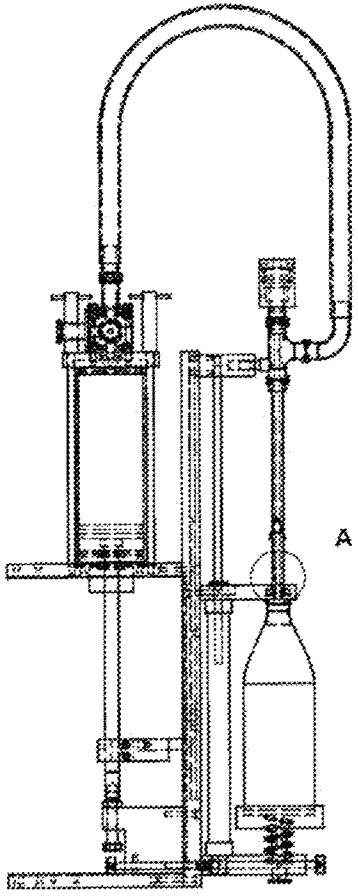
FIG. 7*b*: shows a cross-sectional view of the filler machine shown in FIG. 7*a*.
Figure 7A:
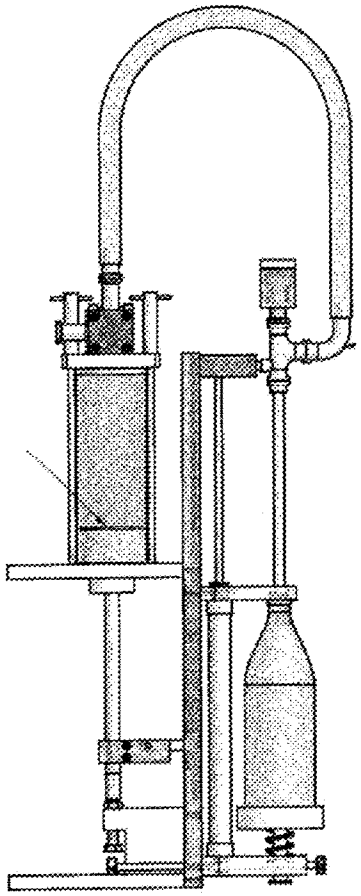
FIG. 7*a*: shows a side view of the filler machine shown in FIG. 1, in a sixth position, in which the filling cycle is complete.

As the filler piston 14 continues to move in an upward direction, the filler tube lifter 20 begins to move the filler tube guide 8 upwards in the same upward direction, as shown in FIG. 6. This movement causes the filler tube 11 to be lifted upwardly in the same direction.

Because the movement of the filler tube 11 out of the bottle 17 is linked with movement of the filler piston 14, the outer or lower end of the filler tube 11, which comprises the filler tube seal 19, will always remain in the beverage in the bottle 17. As shown in FIG. 6, for example, the filler piston 14 is back up to the uppermost starting position. All of the beverage from the filler cylinder has been transferred to the bottle 17, which is now full. The lower or outer end of the filler tube 11 remains in the beverage.

It will therefore be appreciated that as the filler piston 14 moves in an upward direction, the filler cylinder 13 empties its contents into the bottle 17. At the same time, once the filler piston 14 has travelled the predetermined distance B, the bottle 17 will be partially filled and at that point the filler tube 11 may start moving upwardly out of the bottle 17. At all times, however, the lower end of the filler tube 11 and the filler tube seal 19 are located within the beverage.

It should also be appreciated that the diameter of the filling cylinder in relationship to the bottle should be approximately the same size so the relationship between the lift and fill stay the same.

Referring now to FIG. 7, once the filling phase is complete, the filler tube valve 9 is closed and then the filler tube 11 is lifted completely up so that the full bottle 17 can be removed from the filler machine 1 and capped. Another bottle can then be placed in the filler machine 1 for the start of another filling cycle.

In this first aspect of the present invention, the second controlled pressure applied in the filling phase is lower than the first controlled pressure in the charging stage. This is to ensure that the pressure of the beverage as it exits the filler tube is not too high, which could cause sudden excess foaming. This pressure will depend on the amount of carbonation of the beverage.

In one experiment using the filler machine shown in FIGS. 1 to 7 of the accompanying drawings, a 750 ml bottle could be filled in approximately 5 to 6 seconds.

A second aspect of the present invention provides a filler machine that is suitable for carbonated beverages including highly carbonated beverages.

The filler machine of this second aspect of the invention is described in detail below with reference to FIGS. 8 to 19 of the accompanying drawings, but includes the following general features.

The bottle being filled is pressurised and is kept under pressure until it reaches the capper. This pressure may be the same as or higher than the carbonation pressure. The reason for this is so when the filler tube valve opens and the three-way inlet valve and a vent valve are closed the pressure in the bottle stops any beverage coming out of the filler tube until the vent valve allows it.

The filler machine of this second aspect of the invention includes a vent valve that allows for variable release of pressure from within the bottle. This allows for the flow of beverage into the bottle to be controlled, so that the filling speed can to be slow to begin with, speeding up as the bottle fills. This can manage how much foam is produced at the start of the filling. The fill can start slowly and then get faster and faster as the filler tube gets more immersed in the beverage, resulting in a faster fill.

The filler machine of this second aspect of the invention also includes a top seal with more than one chamber or cavity, designed to allow a bottle to be transferred through the filler machine to the capper without losing pressure. A bottle seal is also provided, which allows sealing of the bottle around the neck rather than at the top. Sealing around the neck of the bottle provides a cavity below the top of the bottle so the capper can move into this cavity during capping.

The filler machine of this second aspect of the invention further includes a three-way inlet valve that prevents or substantially reduces air entrapment.

In addition, the filler machine of this second aspect of the invention allows for controlled release of pressure just before capping to cap "on the foam" in a controlled manner. This allows the foam lost to be controlled, to allow for an accurate fill volume.

A filler machine according to the second aspect of the present invention is shown in FIGS. 8-19.

The filler machine 21 of this aspect of the invention operates in a similar manner as the filler machine 1 of the first aspect of the invention described above. In this aspect of the invention, however, the same or higher pressure is maintained during the charging and filling phases and the filling phase includes additional aspects.

Figure 8C:
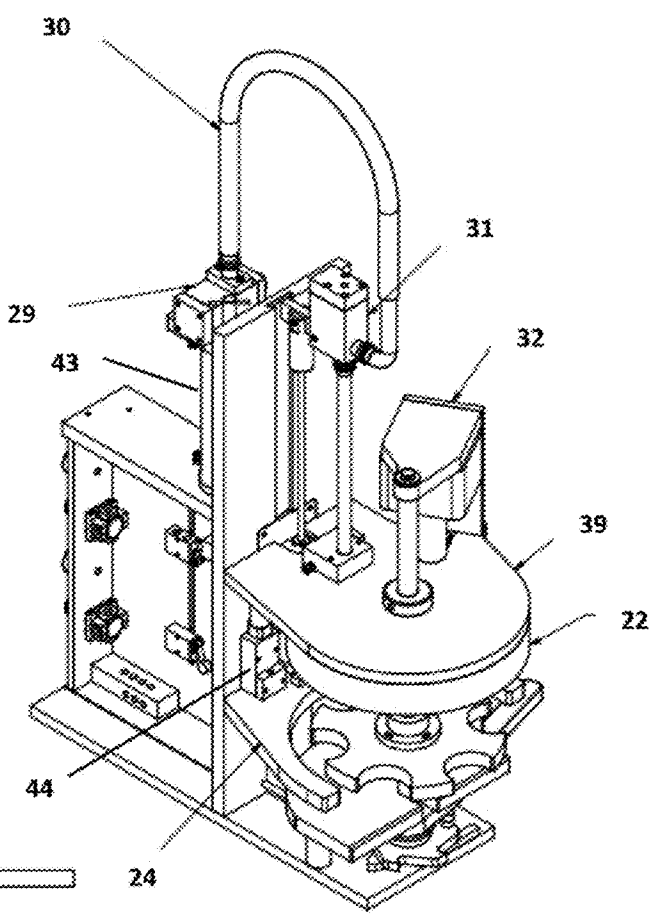
FIG. 8*c*: shows a second perspective view of the filler machine shown in FIG. 8*a*.
Figure 8B:
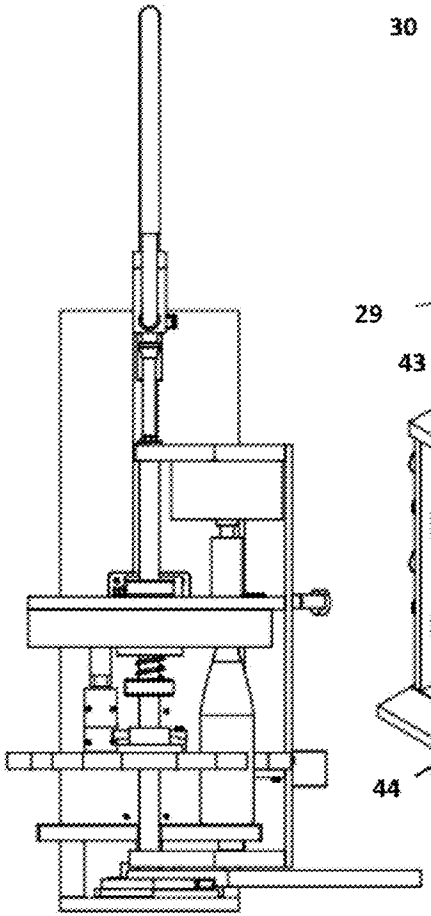
FIG. 8*b*: shows a front view of the filler machine shown in FIG. 8*a*.
Figure 8A:
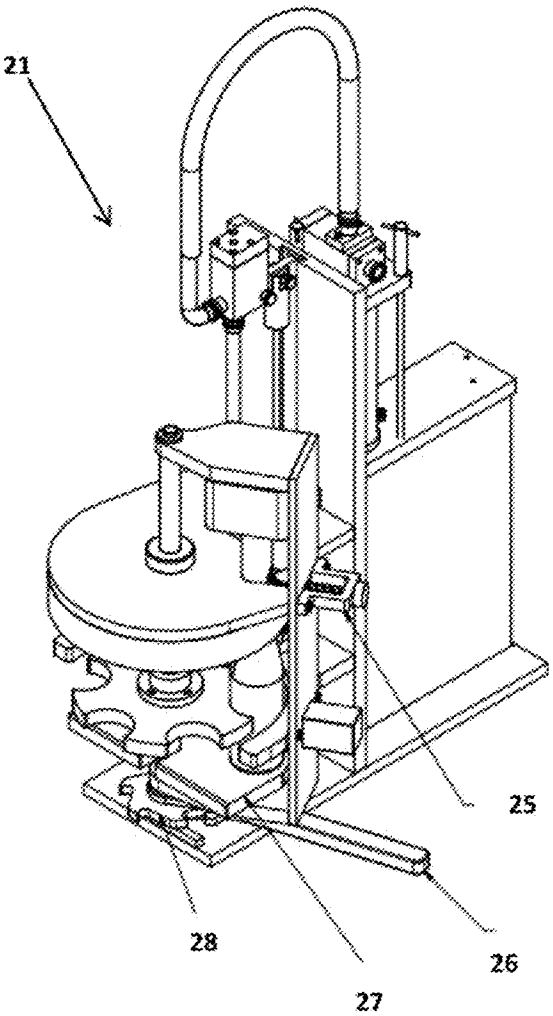
FIG. 8*a*: shows a first perspective view of a filler machine according to a second aspect of the present invention, with a bottle in a capper assembly of the machine.

As shown in FIG. 8*a*, the filler machine 21 comprises a rotary star wheel assembly comprising a rotating bottle seal holder 22, a star wheel 23, a bottle guide 24, a manual cap inserter 25, a manual ratchet handle 26, a bottle support 27 and ratchet 28. Also provided are a three-way inlet valve 29, a flexible hose 30, filler tube assembly 31 and capper assembly 32.

Figure 9C:
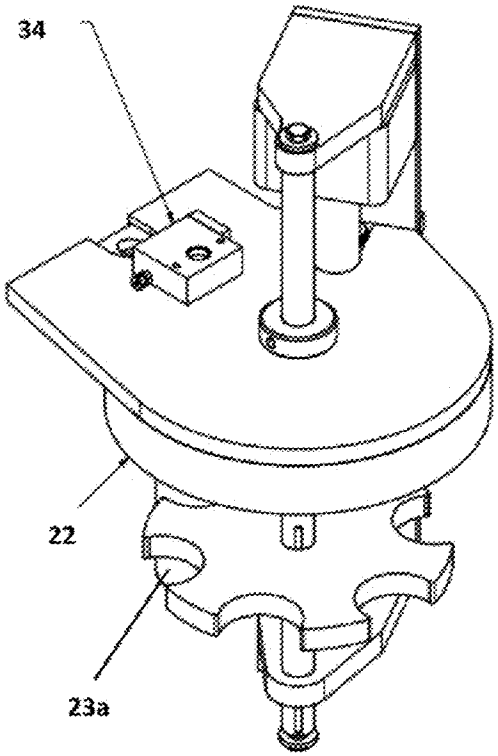
FIG. 9*c*: shows a second perspective view of the assembly shown in FIG. 9*a*.
Figure 9B:
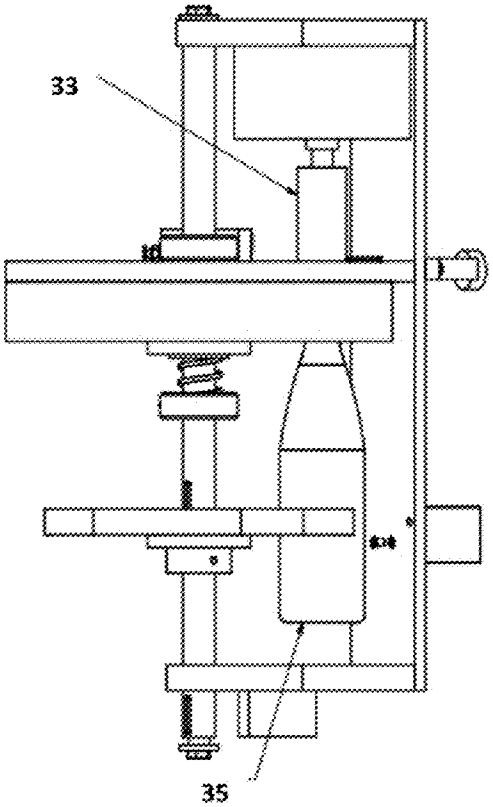
FIG. 9*b*: shows a front view of the assembly shown in FIG. 9*a*.
Figure 9A:
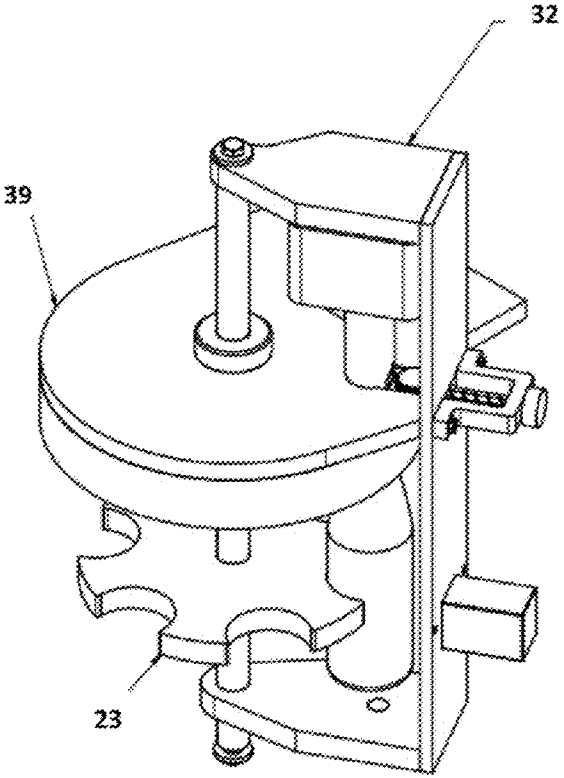
FIG. 9*a*: shows a first perspective view of a rotary star wheel assembly of the filler machine shown in FIG. 8, with a bottle in a capper assembly of the machine.
Figure 10:
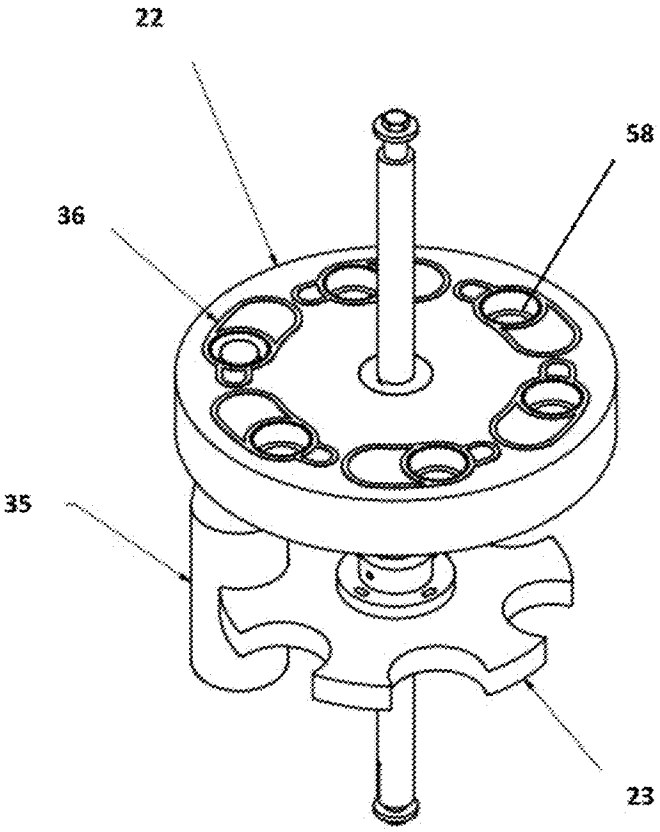
FIG. 10: shows a perspective view of the rotating bottle seal holder and star wheel of the filler machine shown in FIG. 8, with one bottle inserted.

The rotary star wheel assembly is shown in more detail in FIGS. 9 and 10. FIG. 9 also shows a capper cylinder 33, filler tube gland valve 34 and bottle 35, while FIG. 10 also shows the top seal 36.

Filling of a bottle using the filler machine 21 of the present invention is now described.

The charging phase of a filling operation according to this aspect of the invention is the same as that described above for the filler machine 1 of the first aspect of the present invention.

The filling phase has some features to those described for the filling phase of the first aspect of the invention and comprises the following steps:

- an introduction step, during which the bottle 35 is introduced into the filler machine 21;
- an optional evacuation and gas injection step;
- a filling step;
- a venting and capping step; and
- a removal step, during which the bottle 35 is removed from the filler machine 21.

The Introduction Step

Figure 11B:
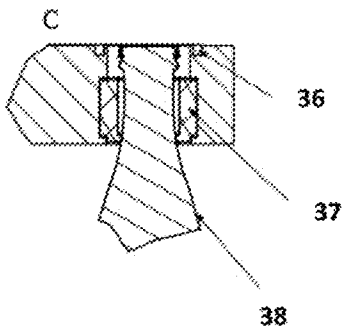
FIG. 11*b*: shows the detail of C of FIG. 11*a*.
Figure 11A:
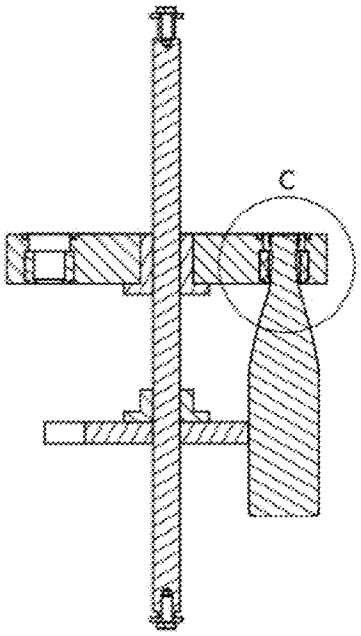
FIG. 11*a*: shows a cross-sectional view of a rotating bottle seal holder shown in FIG. 10.

The filling phase is commenced by first locating a bottle 35 into a bottle location cut-out recess 23*a* of star wheel 23 (see FIG. 9*c*). The bottle 35 is located on support 27, with the neck of the bottle 35 located up into bottle seal 37, as shown in FIG. 11. This bottle placement completely seals the air inside the bottle by bottle seal 37, with the top seal 36 (which may be spring loaded) sealing the top of the bottle 35 to sealing plate 39 (best seen in FIGS. 10 and 11).

The bottle 35 is sealed around the top, but low enough to allow capping.

The Optional Evacuation Step

The bottle 35 is then indexed once in a clockwise direction, using handle 26. At this point, the bottle 35 may optionally evacuated using a vacuum pump or other similar means (not shown) and then optionally charged with an oxygen-free gas.

The Filling Step

The bottle 35 is then indexed a second time into a filling position, using handle 26. As the bottle 35 is indexed into the filling position it activates the lever or switch 38 provided on bottle guide 24, which is shown on more detail in FIG. 12. This action activates a valve (not shown), which starts the filling cycle.

Filler tube 40 starts to come down and the filler tube valve 41 is activated. The filler tube 40 is shown in more detail in FIG. 13.

Upon activation of the filler tube valve 41, pressurised gas (preferably carbon dioxide) pressurises the bottle 35. The pressurised gas may be provided using a gas regulator (not shown). The pressure in the bottle is preferably at least the same pressure as the filler cylinder charging pressure, although this pressure can also be higher in some instances.

Once the filler tube 40 is completely down inside the bottle 35, it activates a valve or switch (not shown) and the filling process starts. At this point, the filling tube seal 42 is opened but no beverage exits the filler tube 40 at this time.

At this point, the three-way inlet valve 29 (shown in more detail in FIG. 14 and described in more detail below) is closed and filler piston cylinder 43 is fully charged with the carbonated beverage.

A vent valve cylinder 44 of vent valve 45 is now activated and the vent valve cylinder 44 starts to retract slowly. The speed of the vent valve cylinder 44 is controlled by a flow restrictor (not shown).

Figure 16B:
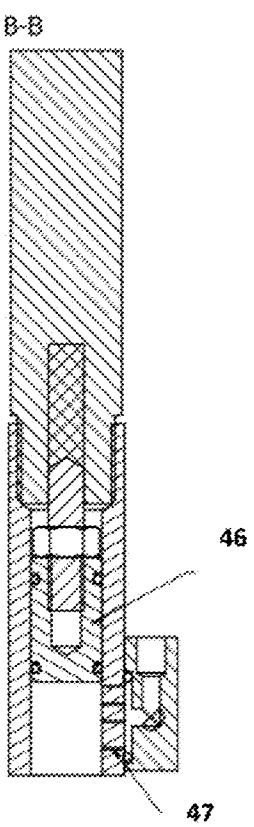
FIGS. 16*a* and 16*b*: show the vent valve shown in FIG. 15, in an open position.
Figure 16A:
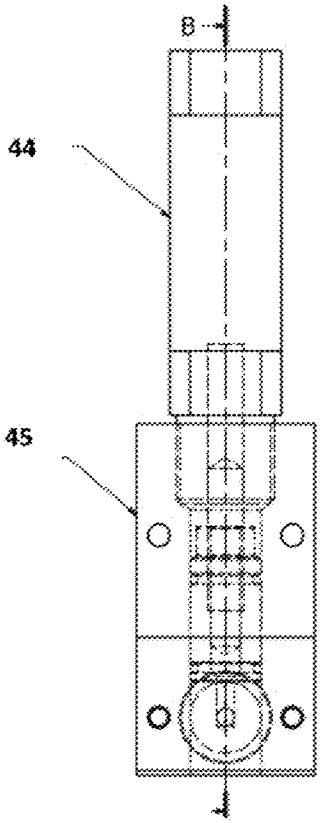
Figure 15B:
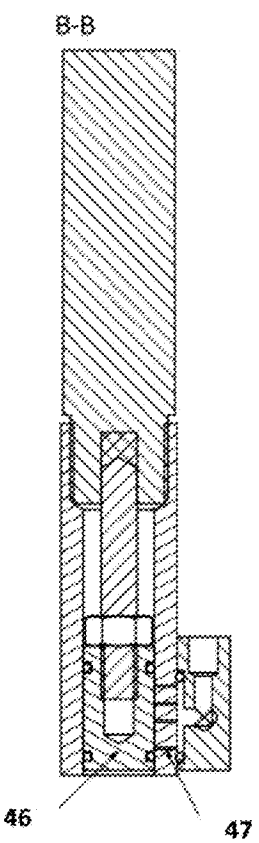
FIGS. 15*a* and 15*b*: show the vent valve of the filler machine shown in FIG. 8, in a closed position.
Figure 15A:
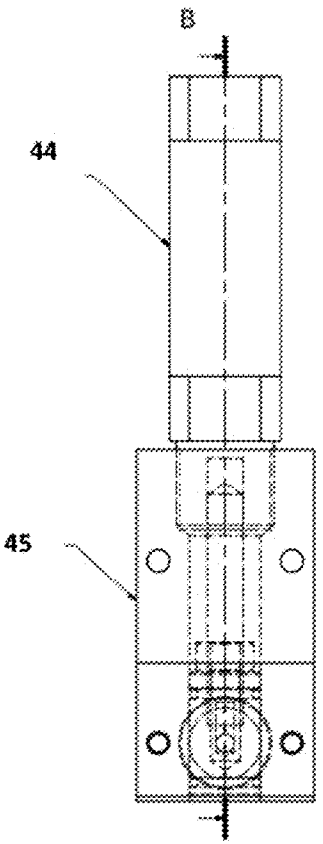

The vent valve 45 is shown in more detail in FIGS. 15 and 16. As the vent valve cylinder 44 retracts, it moves a vent valve spool 46 so a first small exhaust hole 47 in the valve 45 is exposed. This allows the pressurised gas trapped in the bottle 35 to slowly start to bleed out. This, in turn, allows the piston (not shown) of the filler piston cylinder 43 to slowly start pushing the carbonated beverage into the bottle 35. The speed of filling is controlled by this slow bleed off of gas through the vent valve 45.

As the vent valve cylinder 44 retracts further, more exhaust holes 47 are exposed in the vent valve 45. Filling becomes faster every time another exhaust hole 47 is exposed. The size and number of exhaust holes governs the fill speed.

As in the first aspect of the present invention the filler tube 40 lift and position under the beverage is controlled by the shaft of the filler piston (not shown, but see FIG. 5).

Figure 14A:
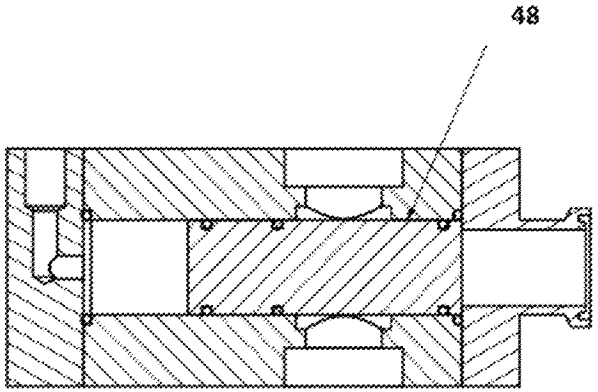
FIG. 14*a*: shows a three-way inlet valve of the filler machine shown in FIG. 8, in a closed position.
Figure 14B:
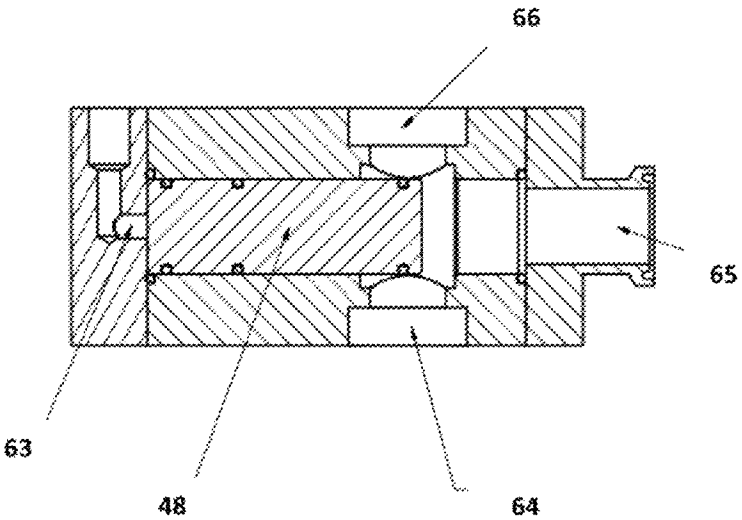
FIG. 14*b*: shows a three-way inlet valve shown in FIG. 14*a*, in an open position.

Once the piston of the filler piston cylinder 43 has completed its full travel up and filling is complete, a valve or switch (not shown) is activated and the three-way inlet valve 29 shown in FIG. 14 is then in turn activated and starts to open. The opening of the three-way inlet valve 29 is achieved by the release of the air on the spool 48 and the pressure of the beverage in the supply tank (not shown).

The speed of the spool 48, when opening, is controlled by restricting the air exhaust off the activating air signal (not shown) on the three-way inlet valve 29. The spool 48 is slowed down while it is opening, to create a time delay before the filler cylinder is charged. This is to ensure the filler cylinder travels its full distance and also to allow enough time for all the control valves (not shown) to activate correctly. Alternatively this time delay can be done electronically.

At the same time as the three-way inlet valve 29 is opening, gas (preferably carbon dioxide), is injected into the top of the full, sealed bottle 35 and the filler tube 40 is lifted all the way up so it is out of the bottle 35.

Filling is now finished.

The Venting and Capping Step Once the bottle 35 is filled, the filler machine 21 is indexed once again around to the capper assembly 32 to allow for venting and capping of the bottle 35.

Figure 17A:
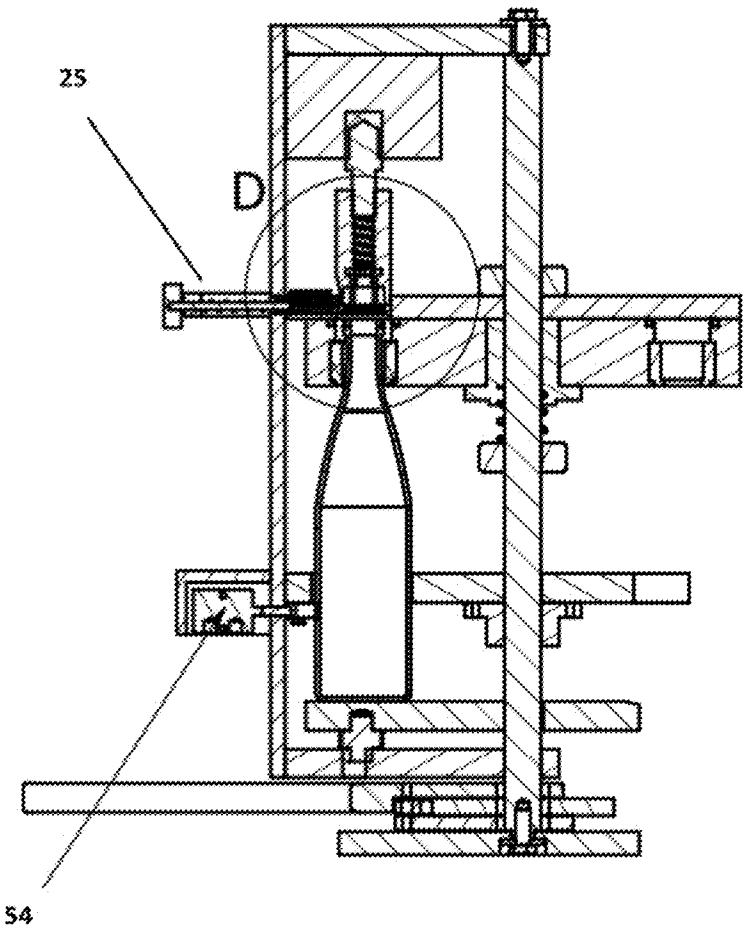
FIG. 17*a*: shows a cross-sectional view of a capper assembly of the filler machine shown in FIG. 8.
Figure 17B:
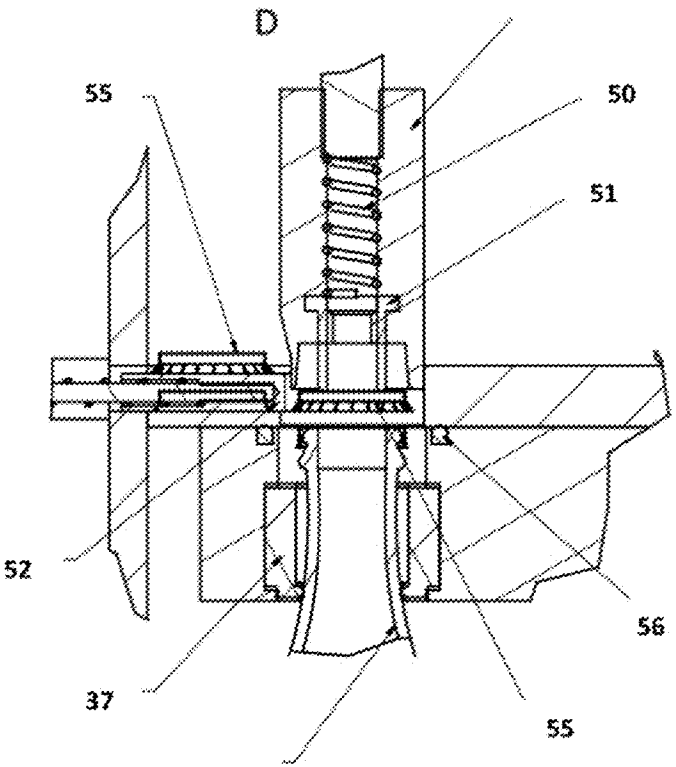
FIG. 17*b*: shows the detail of D of FIG. 17*a*.

As can be seen in FIG. 17, the capper assembly 32 comprises a capper 49 with a spring 50, a cap insertion plug 51 and cap pusher 52.

Figure 12:
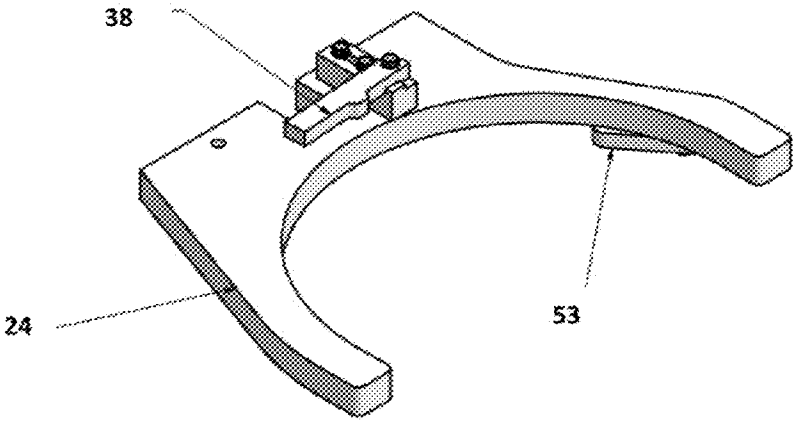
FIG. 12: shows a perspective view of a bottle guide of the filler machine shown in FIG. 8.

As the bottle 35 comes into the capping position it activates the lever 53 (see FIG. 12). The lever 53 in turn activates a valve 54 as shown on FIG. 17 or a switch (not shown). This starts the capping cycle. A cap 55 is already in position under the capper 49 prior to the indexing taking place.

The star wheel 23 indexes, the capper 49 comes down and caps the bottle 35. Then the capper 49 comes back up. At this stage the manual capper inserter 25 (see FIG. 8*a*) can be activated. A cap 55 has been previously placed on top of the cap pusher 52 and when the manual cap inserter 25 is pulled back the cap 55 falls off the top, into a chute and is then pushed under the capper 49. Another cap 55 is placed on the cap pusher 52 before the next indexing.

Venting of the bottle 35 is part of the capping step. Venting is needed to reduce or eliminate the small amount of air or gas that remains in the top of the bottle 35 once it is filled.

One approach is to vent the bottle 35 enough so the carbonated beverage foams and the bottle 35 can be capped "on the foam". When done correctly this minimises any trapped oxygen in the bottle.

In one embodiment, a cavity 56 is provided above the bottle seal 37 to allow the capper 49 to come down far enough to put cap 55 on the bottle 35. As the pressurised, filled bottle 35 comes into the capping position, the cavity 56 along with the cavity in the capper 49 allows the pressure in the bottle 35 to drop. This helps to cause a small amount of foaming which allows for capping on the foam. More foaming can be created by further release of gas either during capping or just before, if needed.

Another approach is to vent only a small amount of the pressurised gas in the bottle 35 and then cap while it is still under pressure. To do this the tolerances and sealing around the head of the capper 49 need to be controlled.

As the bottle 35 travels into position, the air or gas in the bottle 35 can be made to leak around the capper head. The amount of gas can be controlled by the tolerances around the head of the capper 49 and the top sealing plate 39. It could also be controlled by sealing the head of the capper 49 completely and using a needle valve to bleed the gas off to atmosphere.

Alternatively, the amount of foam and gas leakage can also be controlled by the speed with which the capper 49 comes down. The speed of the capper 49 can be controlled with standard pneumatic flow controllers (not shown). The capping can be completed quickly, for example in less than one second. Although crown caps are shown in the accompanying drawings, the filler machine of the present invention may be adapted to allow use of other types of caps, such as screw caps.

The Removal Step

Once the bottle 35 has been vented and capped, it is indexed for a final time so that it may be removed from the filler machine 21.

Other Details of the Filler Machine

Figure 18B:
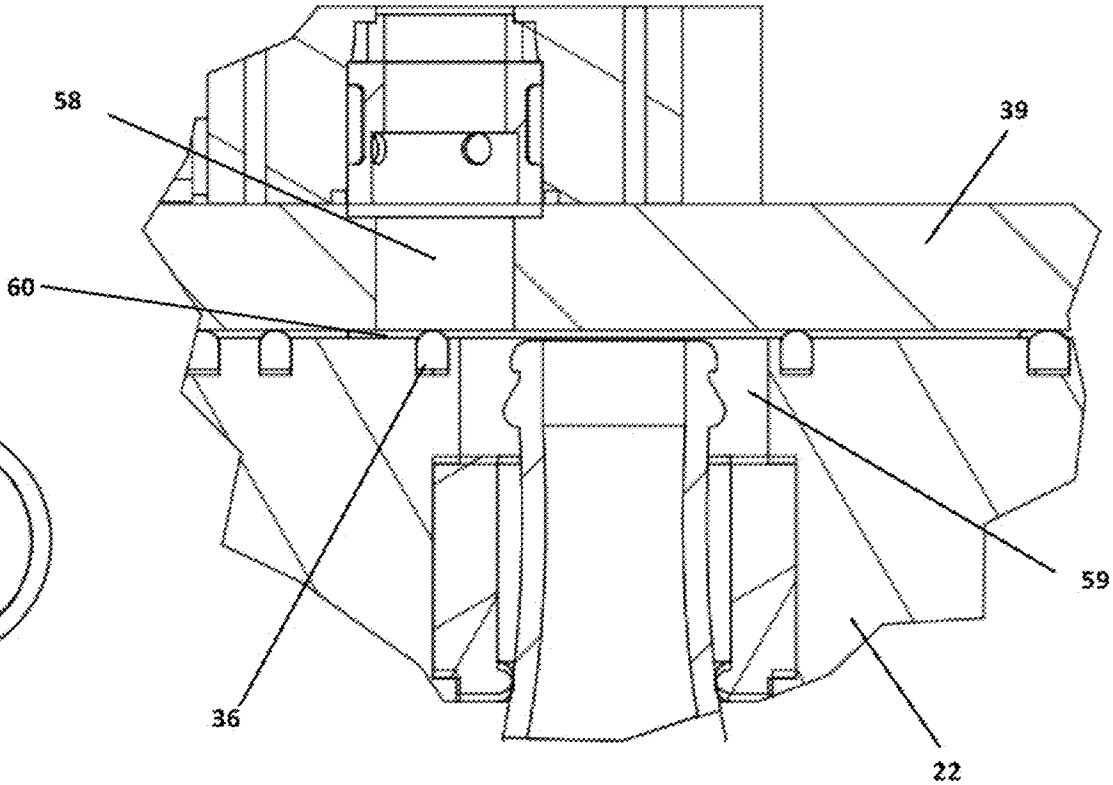
FIG. 18*b*: shows a cross-sectional view of the top seal shown in FIG. 18*a*, when transitioning a filler tube hole.
Figure 18A:
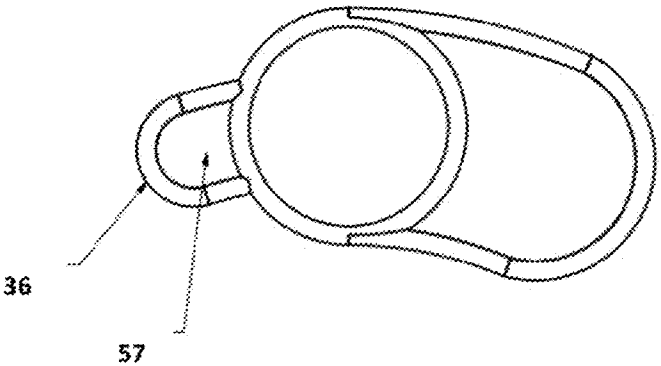
FIG. 18*a*: shows a top view of a top seal of the filler machine shown in FIG. 8.

The top seal 36 is shown in more detail in FIG. 18*a*. The first cavity 57 is adapted to hold the pressure in the bottle as the seal 36 traverses over the hole 58 in the top sealing plate 39 (see also FIG. 10).

As can be seen from FIG. 18*b*, as the holes 58 in the sealing plate 39 and the holes 59 in the rotating bottle seal holder 22 cross over there is a period of time during which gas from the bottle 35 can escape. The very small cavities 60 created by the seal 36 on either side of the holes 58 and 59 capture any escaping gas and stop any further leaking. The same principle applies for the cavity 56 (FIG. 17).

In one preferred embodiment, the seal 36 only has about 0.3 mm clearance from the sealing plate 39 and the rotating bottle seal holder 22. The volume of gas trapped in the cavities 60 is very small.

Figure 13B:
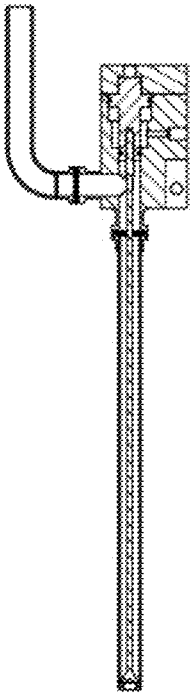
FIG. 13*b*: shows a cross-sectional view of a filler tube valve shown in FIG. 13*a*, in an open position.
Figure 13A:
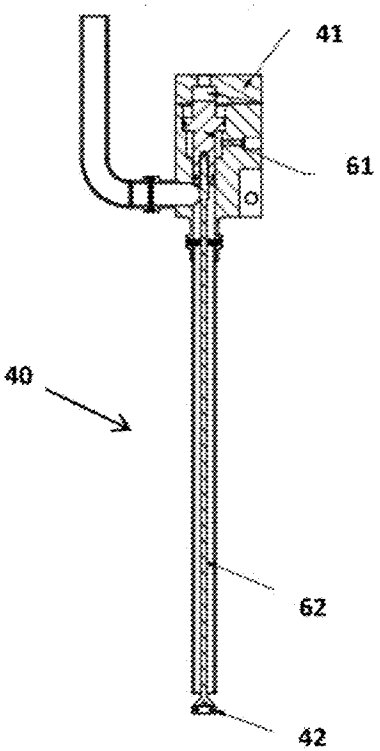
FIG. 13*a*: shows a cross-sectional view of a filler tube valve of the filler machine shown in FIG. 8, in a closed position.

FIG. 13 shows a filler tube 40 according to this second aspect of the present invention. The filler tube valve cap 41 comprises a cavity 61, which in one embodiment may be machined square to accommodate a square topped piston 62. The valve cap 41 may be square machined to stop the piston 62 rotating so the valve stem and filling tube seal 42 can be screwed out from the bottom. In use, the piston 62 comes down far enough that beverage going into the bottle takes any gas (for example, air bubbles in the tube) collected with it.

FIG. 14 shows the three-way inlet valve 29, located above the filler piston cylinder 43. The three-way inlet valve 29 comprises an air signal gallery 63, the valve spool 48, an inlet 64 to the filler cylinder 43, beverage inlet 65 and an outlet 66 to the filler tube 40.

When the pressurised beverage from the supply tank is connected to the inlet 65, the three-way inlet valve 29 is open. The valve 29 is normally open. Once the filler tube piston 62 is all the way down and the filler piston cylinder 43 is fully charged, the three-way inlet valve 29 is activated and closes, for example by high-pressure air injected into the end of the valve spool 48 through the air signal gallery 63 (see FIG. 14*b*).

To open three-way inlet valve 29, the high-pressure air is slowly exhausted and the pressure from the pressurised carbonated beverage in the supply tank moves the valve spool 48. The speed of the valve spool 48 is controlled by a flow restrictor (not shown) in the actuating airline through gallery 63. The design of the three-way inlet valve 29 is such that the valve spool 48 needs to travel a short distance before the three-way inlet valve 29 starts to allow any beverage to flow into the filler cylinder 43 and the filler tube 40. This action creates a short time delay, which allows the piston of the filler cylinder 43 to complete its full stroke. This time delay also allows the controlling sequence valves (not shown) to operate.

The design of three-way inlet valve 29 ensures it cannot trap any pockets of gas in any of its internal chambers. Because the beverage is being pushed by the transfer pressure it fills the hose 30 and the filler cylinder 43 at the same time. Once the hose 30 is full, the flow of beverage continues until it fills the filler cylinder 43.

FIG. 15 and FIG. 16 show the vent valve 45. This valve controls the fill into the bottle 35. If the bottle 35 is pressurised to the same pressure as the pressure on the back side of the piston filler of the filler piston cylinder 43, when the filler tube valve 41 opens then no beverage will move into the bottle 35.

The vent valve cylinder 44 is controlled to open slowly. As the valve spool 46 moves up it uncovers the first hole 47 and allows a small amount of gas from the bottle 35 to escape causing the bottle 35 to start filling slowly. As the valve spool 46 travels up it exposes more and more holes 47, so the fill gets faster and faster until the bottle 35 is full. Once the bottle is full, the vent valve 45 closes and more carbon dioxide is injected through filler tube gland valve 34 back into the bottle 35 as the filler tube 40 is withdrawn.

Figure 19:
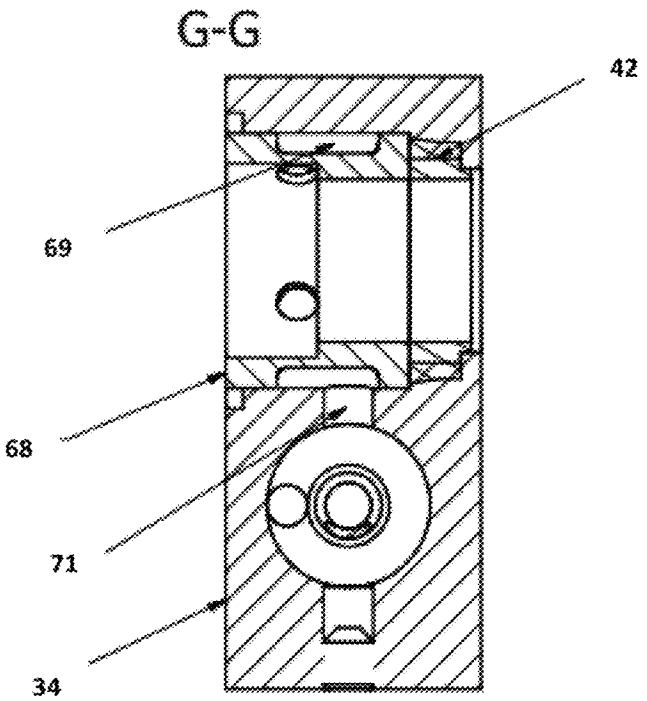
FIG. 19: shows a cross-sectional view of the valve shown in FIG. 19*a*.
Figure 19A:
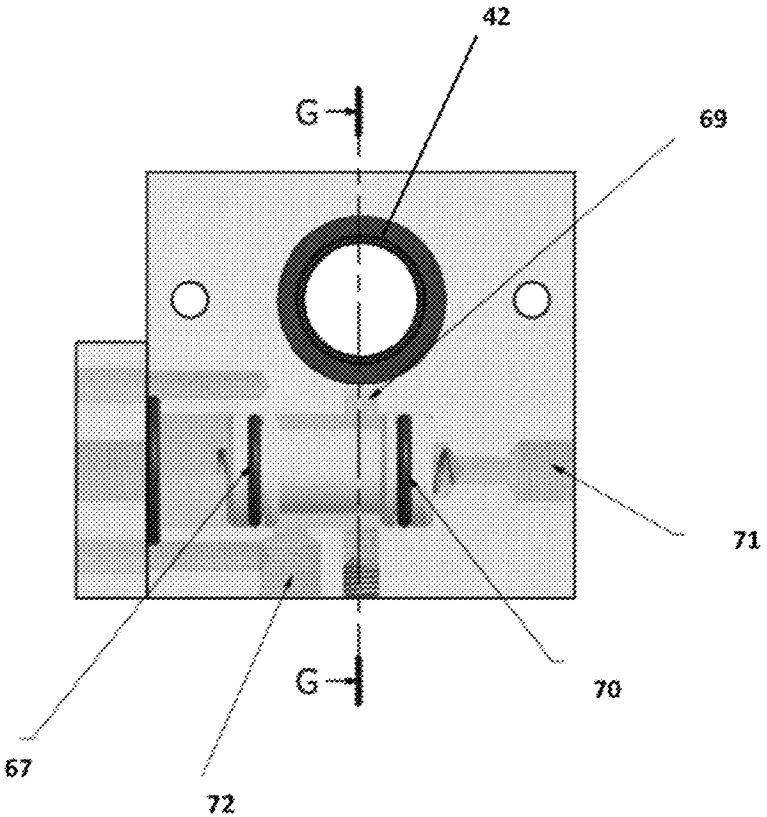
FIG. 19*a*: shows a top view of a filler tube gland valve shown in FIG. 8.

FIG. 19 shows the filler tube gland valve 34. The filler tube gland valve 34 comprises a valve spool 67, filler tube guide 68 with gas galleries (for example gas gallery 69), filler tube seal 42, spring 70, an outlet 71 to vent valve 45 and carbon dioxide inlet 72.

The filler tube gland valve 34, when activated, directs gas (normally carbon dioxide) into the bottle 35 to pressurise it prior to filling. When deactivated, the gas is sent to the vent valve 45. The gas in the bottle 35 now goes through the filler tube gland valve 34 and to the vent valve 45.

In one embodiment, the filler machine shown in FIGS. 8 to 19 of the accompanying drawings, allows for a 750 ml bottle to be filled in approximately 3 to 6 seconds.

In one preferred embodiment, the filler machine of the present invention does not require electric power to operate. It can operate on compressed air and/or carbon dioxide.

It should be appreciated however that the filler machine of the present invention may be produced on a larger scale, and automated for other commercial applications. A larger scale machine according to the present invention may include conveyors to help facilitate the filling process.

A third aspect of the present invention provides a hand filler. This hand filler may be used in a manner similar to the manually operated filler traditionally called a "beer engine."

Currently available beer dispensing taps need to be supplied with low-pressure beer, normally around 4 to 5 pounds per square inch. A problem with this is that if highly carbonated beer is held at this low pressure for too long the beer will lose some of its carbonation.

The hand filler of the present invention eliminates or at least reduces this problem, because higher pressured beer goes into the filler cylinder and then a port valve is changed for filling. This isolates the pressure from the tank so once the filling of a glass or bottle is started the pressure of the fill is controlled by the force of the filling lever.

The advantage of this arrangement is that carbonation is not reduced in the tank or keg over time and recharging of the tank or keg during use is not required.

Figures 20A, 20B, 20C:
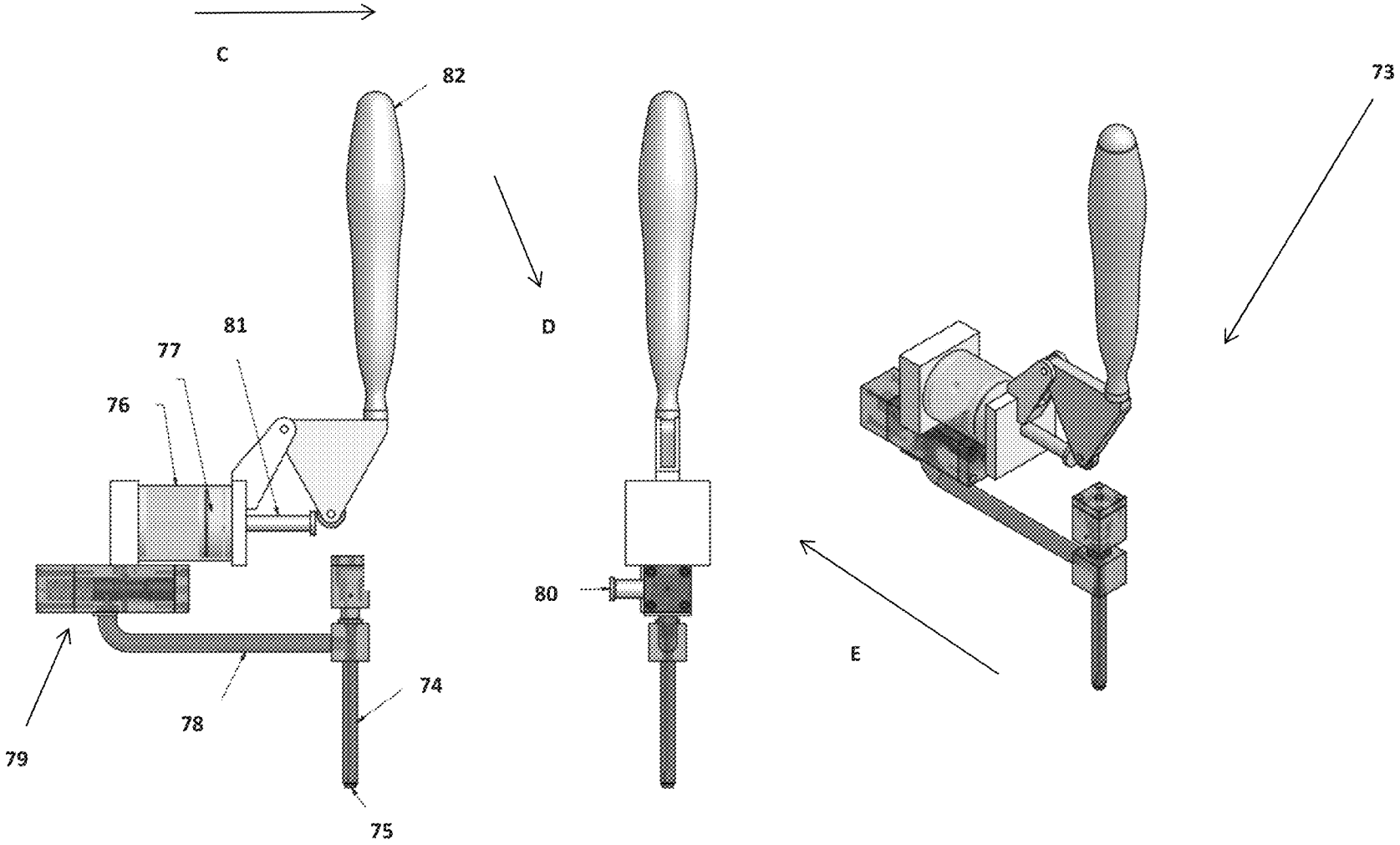
FIG. 20*a*: shows a side view of a hand filler according to a third aspect of the present invention, in a first starting position.
FIG. 20*b*: shows an end view of the hand filler shown in FIG. 20*a*.
FIG. 20*c*: shows a perspective view of the filler machine shown in FIG. 20*a*.

In the embodiment of the invention shown in FIG. 20, the hand filler 73 comprises a filler tube 74 with a filler tube valve 75 at the outer or lower end thereof. The hand filler 73 also comprises a filler cylinder 76 with filler piston 77 and an outlet pipe 78 connecting the filler cylinder 76 to the filler tube 74 via a valve 79. The valve 79 is adapted to connect to (at 80 in FIG. 20*b*) a supply of carbonated beverage such as beer stored in a tank or keg (not shown).

The filler piston 77 includes a filler cylinder plunger 81, which is connected to a fill handle 82.

In use, the valve 79 is opened so that the carbonated beverage from the keg or tank flows under pressure into the filler cylinder 76. This pushes the filler piston 77 in the direction indicated by the arrow C. The valve 79 is then closed, ensuring that pressure in the keg or tank is maintained and carbonated beverage in the filler cylinder 76 and filler tube 74 is isolated. As the filler tube valve 75 is also still in the closed position, pressure in the remainder of the system is also maintained. The filler tube 74 is then located in a glass or bottle (not shown).

The filler tube valve 75 is opened and the fill handle 82 may then by activated by moving it in an outward and downward direction as indicated by the arrow D. This movement causes the filler cylinder plunger 81 to be moved in the direction of arrow E, in turn causing the beverage in the filler cylinder 76 to flow into bottle via the outlet pipe 78 and filler tube 74, to allow filing of a glass or bottle.

A fourth aspect of the present invention provides a filler machine similar to that provided by the second aspect of the invention, but with the bottle remaining stationary and the capper assembly operating using a linear side movement.

The filler machine 83 of this aspect of the invention is shown in FIG. 21. In use, the bottle 35 is placed into the filling position in bottle seal holder 84.

Figures 21A, 21B, 21C, 21D:
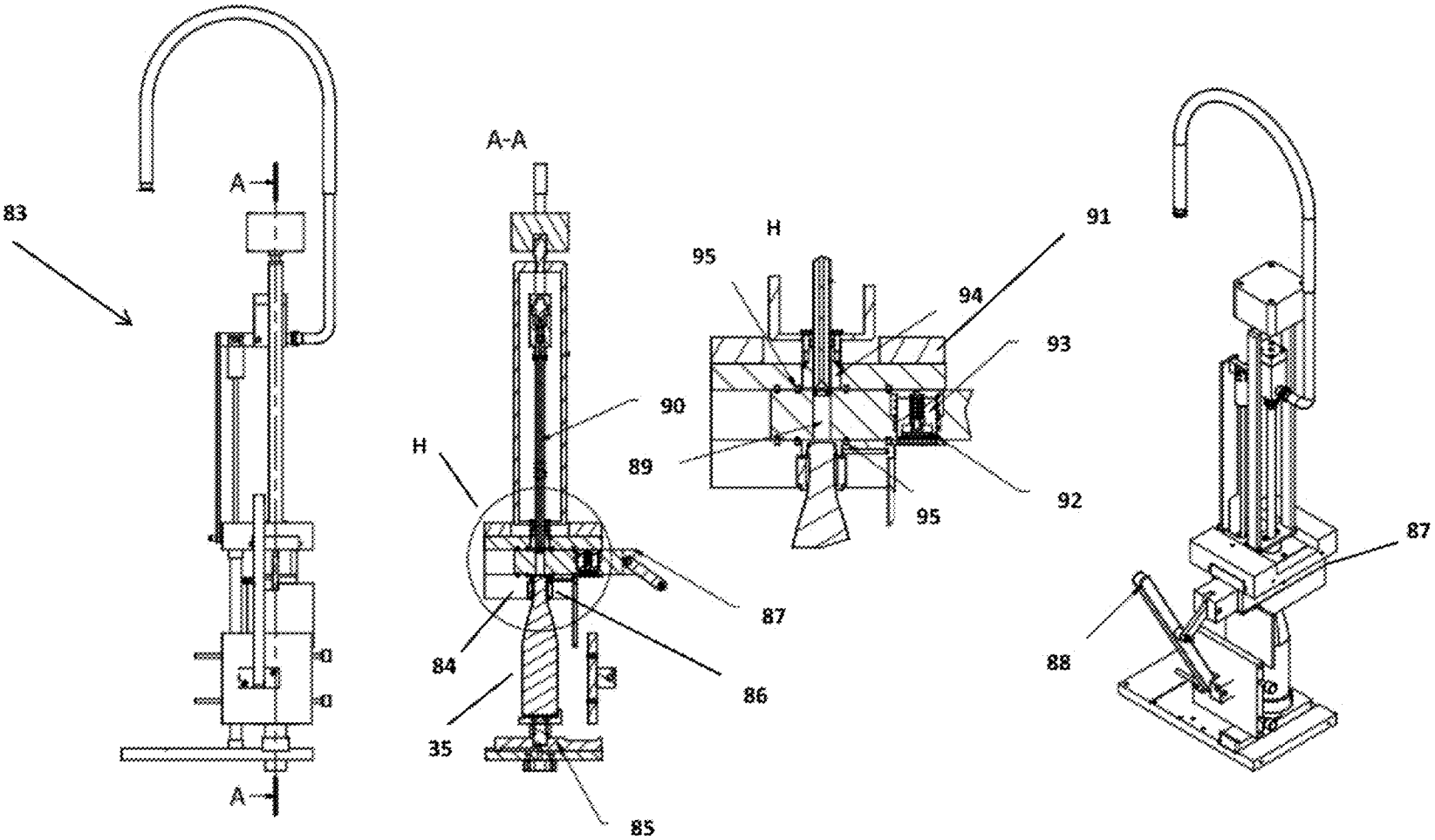
FIG. 21*a*: shows a side view of a filler machine according to a fourth aspect of the present invention.
FIG. 21*b*: shows a cross-sectional view of the filler machine shown in FIG. 21*a*.
FIG. 21*c*: shows the detail of H of FIG. 21*b*.
FIG. 21*d*: shows a perspective view of the filler machine shown in FIG. 21*a*.

The bottle 35 is supported by bottle support 85, which is adapted to move sideways in the direction F shown in FIG. 21*b*. This is required so there is enough room under the bottle seal holder 84 for the bottle 35 to be placed up into the bottle seal 86. The bottle support 85 is then slid back into position so it can support the bottle 35.

Prior to filling, sliding capper assembly 87 is moved using handle 88, opening up filling hole 89 which is in line with the bottle 35. This position of the sliding capper assembly 87 is shown in detailed view B of FIG. 21*c*.

When filling is initiated filler tube 90 comes down through filler head 91 and fills the bottle 35. The filling process is substantially the same as described above for the second aspect of the present invention.

While the filling is taking place, cap 92 can be manually (or automatically) placed into the capper 93. Once the bottle 35 is filled, the sliding capping assembly 87 can be moved so the cap 92 is now located above the top of the bottle 35 and under the capper pusher 94. Capping can then take place.

This is all done while maintaining the gas pressure in the bottle 35.

The sealing of the sliding capper assembly 87 in this aspect of the invention is achieved using a seal 95 that applies the same principles as the top seal 36 described above, by creating the gas entrapment during the transition over the filling and capping holes. The filler machine 83 of the fourth aspect of the present invention requires two of these seals, one on the top portion of the sliding capping head assembly 87 and one on the bottom portion of the sliding capping head assembly 87. This system allows the pressure in the bottle 35 to be maintained. The capper 93 can be vented prior to capping to allow "capping on the foam."

As will be appreciated from the description above, the present invention provides filler machines and methods that allow efficient and/or accurate filling of containers such as bottles.

The term 'comprising' as used in this specification means 'consisting at least in part of', that is to say when interpreting statements in this specification which include that term, the features, prefaced by that term in each statement, all need to be present but other features can also be present.

The present invention and its embodiments have been described in detail. However, the scope of the present invention is not intended to be limited to the embodiment described in the specification. Modifications and variations may be made to the disclosed embodiment without departing from the scope or essential characteristics of the present invention.

The invention claimed is:

1. A capping assembly to allow capping of a filled bottle under pressure, the capping assembly comprising:

a top sealing plate comprising at least one hole;

below the top sealing plate, a rotating bottle seal holder comprising a plurality of top seals, each top seal comprising a chamber and, adjacent to the chamber, a hole that transverses the bottle seal holder;

within the bottle seal holder, a plurality of neck seals, each neck seal allowing sealing of the filled bottle around the neck of the filled bottle rather than at the top of the filled bottle;

below the bottle seal holder, a rotating wheel comprising at least one recess for contacting the side of the filled bottle;

below the rotating wheel, a bottle support comprising a surface for supporting the bottom of the filled bottle;

wherein, by placement in the neck seal, the filled bottle is able to be positioned such that the top of the filled bottle extends into the hole of the top seal, the top seal contacting an underside of the top sealing plate and thereby sealing air or gas inside the filled bottle, while the bottom of the filled bottle contacts the bottle support; and wherein, by placement in the recess of the rotating wheel, the filled bottle is able to be rotated along with the rotating wheel, thereby transiting the top of the filled bottle and the top seal along the underside of the top sealing plate, in this way keeping the filled bottle under pressure until the top of the filled bottle crosses over the hole of the top sealing plate and capping can take place.

2. The capping assembly of claim 1, wherein the chamber of the top seal is adapted to hold pressure in the filled bottle as the top seal traverses over the hole in the top sealing plate.

3. The capping assembly of claim 1, wherein the top seal is spring loaded.

4. The capping assembly of claim 1, wherein the neck seal allows for a cavity positioned above the neck seal.

5. The capping assembly of claim 4, wherein the cavity positioned above the neck seal allows for a capper to access the top of the filled bottle during capping.

6. The capping assembly of claim 1, wherein the assembly further comprises a capper.

7. The capping assembly of claim 6, wherein the capper comprises a spring, a cap insertion plug, and a cap pusher.

8. The capping assembly of claim 6, wherein the capper includes means for venting air or gas from the filled bottle.

9. The capping assembly of claim 8, wherein the means for venting air or gas is a needle valve.

10. The capping assembly of claim 8, wherein the capper comprises a cavity to allow pressure in the filled bottle to be released during capping.

11. The capping assembly of claim 8, wherein the capper allows for foam lost to be controlled, and in this way provide an accurate liquid volume for the filled bottle.

12. The capping assembly of claim 6, wherein operation of the capper is controlled with a pneumatic flow controller.

13. The capping assembly of claim 6, wherein the capper is activated by a lever.

14. The capping assembly of claim 13, wherein the lever activates a valve or a switch to start a capping cycle.

15. The capping assembly of claim 6, wherein the capper is adapted to apply crown caps or screw caps.

16. The capping assembly of claim 1, wherein the top seal allows for about 0.3 mm clearance between the top sealing plate and the rotating bottle seal holder.

17. The capping assembly of claim 1, wherein the pressure in the filled bottle is the same as or higher than carbonation pressure.

* * * * *